US009930942B2

(12) United States Patent
Ma

(10) Patent No.: US 9,930,942 B2
(45) Date of Patent: Apr. 3, 2018

(54) CANTILEVER UMBRELLA WITH INTEGRATED CONTROL MECHANISMS

(71) Applicant: Oliver Joen-an Ma, Arcadia, CA (US)

(72) Inventor: Oliver Joen-an Ma, Arcadia, CA (US)

(73) Assignee: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 14/982,585

(22) Filed: Dec. 29, 2015

(65) Prior Publication Data

US 2016/0183647 A1 Jun. 30, 2016

Related U.S. Application Data

(60) Provisional application No. 62/098,258, filed on Dec. 30, 2014.

(51) Int. Cl.

| | |
|---|---|
| ***A45B 23/00*** | (2006.01) |
| ***A45B 25/02*** | (2006.01) |
| ***A45B 17/00*** | (2006.01) |

(52) U.S. Cl.

CPC ..... *A45B 23/00* (2013.01); *A45B 17/00* (2013.01); *A45B 25/02* (2013.01); *A45B 2023/0037* (2013.01)

(58) Field of Classification Search

CPC ..... A45B 23/00; A45B 2023/0037; A45B 2025/146

See application file for complete search history.

(56) References Cited

U.S. PATENT DOCUMENTS

| | | | |
|---|---|---|---|
| 2,183,833 | A | 12/1939 | Farhar |
| 2,235,518 | A | 3/1941 | Goshaw |
| 2,475,406 | A | 7/1949 | Russell |
| 2,661,752 | A | 12/1953 | Kampf et al. |
| 2,670,133 | A | 2/1954 | Volker |
| 2,721,569 | A | 10/1955 | Militano |
| 2,724,396 | A | 11/1955 | Pereira |
| 2,905,187 | A | 9/1959 | Croce |
| 2,914,154 | A | 11/1959 | Russell |
| 3,120,238 | A | 2/1964 | Glatz |

(Continued)

FOREIGN PATENT DOCUMENTS

| | | | |
|---|---|---|---|
| CN | 2419864 | Y | 2/2001 |
| CN | 2441342 | Y | 8/2001 |

(Continued)

OTHER PUBLICATIONS

Operation Manual Easy Sun Parasol Sunshade (Issue: Jul. 2004) pp. 1-17.

(Continued)

*Primary Examiner* — Noah Chandler Hawk

(74) *Attorney, Agent, or Firm* — Knobbe Martens Olson & Bear, LLP

(57) ABSTRACT

Umbrella assemblies described herein are configured to retract and extend, tilt side to side, and open and close. In some embodiments, the umbrella assembly can include a cantilevered beam. The umbrella assembly can further include a tilt mechanism operable to rotate the canopy frame. The umbrella assembly can include a clutch mechanism fixed to the cantilevered beam. The umbrella assembly can also include an integrated mechanism to both open and close the canopy frame and raise and lower the cantilevered beam.

28 Claims, 29 Drawing Sheets

(56) References Cited

U.S. PATENT DOCUMENTS

| | | | |
|---|---|---|---|
| 3,129,715 | A | 4/1964 | Fleischer et al. |
| 3,142,307 | A | 7/1964 | Danciart et al. |
| 3,145,720 | A | 8/1964 | Torii |
| 3,150,671 | A | 9/1964 | Frey |
| 3,175,568 | A | 3/1965 | Kafka |
| 3,182,673 | A | 5/1965 | Small |
| 3,486,514 | A | 12/1969 | Prescott |
| 3,765,434 | A | 10/1973 | Riggs |
| 3,926,202 | A | 12/1975 | Uthemann et al. |
| 4,148,164 | A | 4/1979 | Humphrey |
| 4,582,078 | A | 4/1986 | Ma |
| 4,586,525 | A | 5/1986 | Glatz et al. |
| 4,606,366 | A | 8/1986 | Collet |
| 4,622,987 | A | 11/1986 | Redl et al. |
| 4,674,523 | A | 6/1987 | Glatz |
| 4,697,606 | A | 10/1987 | Ma |
| 4,878,509 | A | 11/1989 | Tung |
| 5,002,081 | A | 3/1991 | Stromeyers |
| 5,029,596 | A | 7/1991 | Tung |
| 5,086,797 | A | 2/1992 | Earnshaw et al. |
| 5,116,258 | A | 5/1992 | Vennik |
| 5,156,395 | A | 10/1992 | Smith |
| 5,161,764 | A | 11/1992 | Roney |
| 5,349,975 | A | 9/1994 | Valdner |
| 5,437,297 | A | 8/1995 | Crisman et al. |
| 5,492,232 | A | 2/1996 | Ohm |
| 5,499,644 | A | 3/1996 | Geniele |
| 5,584,564 | A | 12/1996 | Phyle |
| 5,611,364 | A | 3/1997 | Woods et al. |
| 5,678,585 | A | 10/1997 | May |
| 5,711,333 | A | 1/1998 | Vanderminden, Sr. |
| 5,735,302 | A | 4/1998 | Saliva |
| 5,785,069 | A | 7/1998 | Glatz |
| D398,443 | S | 9/1998 | Bolle |
| 5,845,665 | A | 12/1998 | Koehn |
| 5,868,152 | A | 2/1999 | Brown |
| 5,871,024 | A | 2/1999 | Vendermindern, Sr. |
| 5,937,882 | A | 8/1999 | Harbaugh |
| 5,960,806 | A | 10/1999 | Steiner |
| 6,014,980 | A | 1/2000 | Glatz |
| D434,215 | S | 11/2000 | Lin |
| 6,152,156 | A | 11/2000 | Tung |
| D434,556 | S | 12/2000 | Lin |
| 6,196,244 | B1 | 3/2001 | Haddad et al. |
| 6,209,147 | B1 | 4/2001 | Wheaton |
| 6,220,261 | B1 | 4/2001 | Glatz |
| 6,311,705 | B1 | 11/2001 | Ma |
| 6,321,763 | B1 | 11/2001 | Ma |
| 6,330,886 | B1 | 12/2001 | Culver |
| 6,435,444 | B1 | 8/2002 | Lin |
| 6,446,650 | B1 | 9/2002 | Ma |
| 6,478,037 | B2 | 11/2002 | Tung |
| 6,520,192 | B1 | 2/2003 | Lo |
| 6,571,403 | B2 | 6/2003 | Wheaton |
| 6,575,182 | B2 | 6/2003 | Tung |
| 6,575,183 | B2 | 6/2003 | Tung |
| D477,458 | S | 7/2003 | Goldwitz |
| 6,588,438 | B1 | 7/2003 | Steiner |
| 6,607,002 | B2 | 8/2003 | Reese |
| 6,619,306 | B2 | 9/2003 | Ma |
| 6,662,815 | B2 | 12/2003 | Tung |
| 6,761,180 | B1 | 7/2004 | Lai |
| D497,479 | S | 10/2004 | Yu |
| 6,827,094 | B1 | 12/2004 | Bramwells |
| 6,837,255 | B2 | 1/2005 | Bunch et al. |
| 6,840,253 | B2 | 1/2005 | Ma |
| 6,851,823 | B2 | 2/2005 | Bilotti |
| 6,923,193 | B2 | 8/2005 | Chen |
| 6,926,019 | B2 | 8/2005 | Glatz |
| 6,945,263 | B2 | 9/2005 | Li |
| 6,953,043 | B2 | 10/2005 | Yu |
| 6,988,504 | B1 | 1/2006 | Goldwitz |
| D518,629 | S | 4/2006 | Ma |
| 7,108,388 | B2 | 9/2006 | Li |
| 7,134,442 | B2 | 11/2006 | Ma |
| 7,156,114 | B2 | 1/2007 | Lo |
| 7,207,343 | B2 | 4/2007 | Earnshaw et al. |
| 7,255,118 | B2 | 8/2007 | Vardy et al. |
| 7,341,068 | B2 | 3/2008 | Liu |
| 7,398,790 | B2 | 7/2008 | Glatz |
| 7,412,985 | B2 | 8/2008 | Ma |
| 7,493,909 | B2 | 2/2009 | Ma |
| 7,520,289 | B1 | 4/2009 | Barber |
| 7,533,680 | B2 | 5/2009 | Ma |
| 7,556,051 | B2 | 7/2009 | Lai |
| 7,708,022 | B2 | 5/2010 | Ma |
| 7,717,121 | B2 | 5/2010 | Glatz |
| D621,600 | S | 8/2010 | He |
| 7,866,331 | B2 | 1/2011 | Glatz |
| 7,886,755 | B2 | 2/2011 | Tung |
| 7,913,707 | B2 | 3/2011 | Lai |
| 7,918,054 | B2 | 4/2011 | Grafton |
| D638,622 | S | 5/2011 | He |
| 7,980,261 | B2 | 7/2011 | Glatz |
| 8,066,021 | B2 | 11/2011 | Ma |
| 8,104,492 | B2 | 1/2012 | Dan |
| 8,113,223 | B2 | 2/2012 | Wang et al. |
| 8,360,080 | B2 | 1/2013 | Liu et al. |
| 8,522,804 | B1 | 9/2013 | Tung |
| 9,220,325 | B2 | 12/2015 | Ma |
| 9,237,785 | B2 | 1/2016 | Ma |
| 9,289,038 | B2 | 3/2016 | Ma |
| 9,642,421 | B2 | 5/2017 | Ma |
| 2002/0083969 | A1 | 7/2002 | Tung |
| 2002/0104557 | A1 | 8/2002 | Tung |
| 2002/0129847 | A1 | 9/2002 | Ma |
| 2002/0174887 | A1 | 11/2002 | Reese |
| 2003/0010366 | A1 | 1/2003 | Glatz |
| 2003/0015230 | A1 | 1/2003 | Glatz |
| 2004/0031513 | A1 | 2/2004 | Bunch et al. |
| 2004/0055627 | A1 | 3/2004 | Moga |
| 2004/0055628 | A1 | 3/2004 | Yu |
| 2004/0069333 | A1 | 4/2004 | Ma |
| 2004/0177871 | A1 | 9/2004 | Harbaugh |
| 2004/0182429 | A1 | 9/2004 | Chen |
| 2004/0261827 | A1 | 12/2004 | Chen |
| 2005/0013130 | A1 | 1/2005 | Li |
| 2005/0016571 | A1 | 1/2005 | Wu |
| 2005/0028852 | A1 | 2/2005 | Reese |
| 2005/0041425 | A1 | 2/2005 | Li |
| 2005/0183762 | A1 | 8/2005 | Ma |
| 2005/0229957 | A1 | 10/2005 | Glatz |
| 2005/0268952 | A1 | 12/2005 | Ma |
| 2005/0268953 | A1 | 12/2005 | Ma |
| 2006/0081277 | A1 | 4/2006 | Liu |
| 2006/0169307 | A1 | 8/2006 | Lo |
| 2006/0201542 | A1 | 9/2006 | Ma |
| 2006/0243311 | A1 | 11/2006 | Glatz |
| 2006/0278262 | A1 | 12/2006 | Ma |
| 2007/0074751 | A1 | 4/2007 | Fraser |
| 2007/0163632 | A1 | 7/2007 | Chang |
| 2007/0209688 | A1 | 9/2007 | Earnshaw |
| 2008/0236640 | A1* | 10/2008 | Huali ..... A45B 23/00 135/20.3 |
| 2010/0051074 | A1 | 3/2010 | Dan |
| 2010/0101614 | A1 | 4/2010 | Wang et al. |
| 2010/0192997 | A1 | 8/2010 | Liu et al. |
| 2010/0212705 | A1 | 8/2010 | Tung |
| 2011/0005558 | A1 | 1/2011 | Lai |
| 2013/0092200 | A1 | 4/2013 | May |
| 2013/0333734 | A1 | 12/2013 | Ma |
| 2014/0158173 | A1 | 6/2014 | Li et al. |
| 2014/0166060 | A1 | 6/2014 | Ma |
| 2014/0230867 | A1 | 8/2014 | Ma |
| 2014/0311537 | A1 | 10/2014 | Ma |
| 2015/0059815 | A1 | 3/2015 | Xiong |
| 2015/0068567 | A1 | 3/2015 | Ma |

FOREIGN PATENT DOCUMENTS

| | | | |
|---|---|---|---|
| CN | 2621472 | Y | 6/2004 |
| CN | 2843147 | Y | 12/2006 |
| CN | 2896981 | | 5/2007 |
| CN | 201001460 | Y | 1/2008 |

(56) References Cited

FOREIGN PATENT DOCUMENTS

| | | | |
|---|---|---|---|
| CN | 201001463 | Y | 1/2008 |
| CN | 201076109 | Y | 6/2008 |
| CN | 201135192 | Y | 10/2008 |
| CN | 201197439 | Y | 2/2009 |
| CN | 201207982 | Y | 3/2009 |
| CN | 201518827 | U | 7/2010 |
| DE | 580503 | | 7/1933 |
| DE | 2259192 | | 6/1974 |
| DE | 3229776 | | 4/1983 |
| DE | 3820573 | | 8/1989 |
| DE | 297 12 024 | | 9/1997 |
| DE | 299 06 116 | | 8/1999 |
| DE | 20205561 | | 7/2002 |
| DE | 10 2008 034 985 | | 2/2010 |
| EP | 0 392 989 | | 10/1990 |
| EP | 1 400 186 | | 3/2004 |
| EP | 1 700 536 | | 9/2006 |
| EP | 2 103 230 | | 9/2009 |
| EP | 2 425 738 | | 3/2012 |
| GB | 22218 | | 9/1911 |
| WO | WO 97/04682 | | 2/1997 |
| WO | WO 00/55456 | | 9/2000 |
| WO | WO 05/018369 | | 7/2004 |

OTHER PUBLICATIONS

Treasure Garden's product brochure identified as "AG3 9' Centilever Umbrella", p. 2.

Extended European Search Report issued in European Patent Application No. 14155827.0, dated Apr. 29, 2014, in 6 pages.

Extended European Search Report issued in European Patent Application No. 14183987.8, dated Oct. 15, 2014, in 6 pages.

Extended European Search Report issued in European Patent Application No. 14183979.5, dated Oct. 16, 2014, in 6 pages.

Extended European Search Report issued in European Patent Application No. 14185661.7, dated Feb. 4, 2015, in 8 pages.

International Search Report and Written Opinion issued in PCT Application No. PCT/US2015/067956, dated Apr. 28, 2016 in 13 pages.

Activa Leisure, 2010 Product Catalog.

Treasure Garden, 2010 Product Catalog.

* cited by examiner

CANTILEVER UMBRELLA WITH INTEGRATED CONTROL MECHANISMS

INCORPORATION BY REFERENCE TO ANY PRIORITY APPLICATIONS

Any and all applications for which a foreign or domestic priority claim is identified in the Application Data Sheet as filed with the present application, including U.S. 61/766,640, are hereby incorporated by reference under 37 C.F.R. § 1.57.

BACKGROUND OF THE INVENTION

Field of the Invention

This application relates to the field of shade structures, particularly to umbrellas or parasols with an offset or side support pole and boom mounted canopy control devices. A side supported umbrella is sometimes referred to herein as a cantilever umbrella.

Description of the Related Art

Umbrellas or parasols are typically used in outdoor settings to provide shade. In these shade structures a canopy assembly is provided that comprises a fabric or similar material mounted over a plurality of support ribs. The support ribs can be collapsed for storage and extended to hold up and extend the fabric and thereby provide shade. The canopy assembly can be supported from beneath or from above. Umbrellas supported from above have the advantage of providing space below the canopy where people can sit without the obstruction of a pole extending from below the canopy to the ground. Umbrellas supported from above can have a mechanism for tensioning the canopy frame disposed on the side pole, either in a fixed position or on a slide.

SUMMARY OF THE INVENTION

Users would benefit from a cantilever umbrella that has more functionality than merely opening and closing the canopy. In particular, it would be a great advance to enable the user to not only open and close the umbrella at a side pole but also to be able to change the configuration of the umbrella to suit the conditions. A cantilever umbrella with multiple mechanisms to control opening and closing, clutching, and tilting operations could be unwieldy. Therefore, there is a need for a new cantilever umbrella assembly that simplifies or integrates more than one control function into one or more integrated control mechanisms to control up and down and open and close operation of the canopy.

There is a need for new cantilever umbrellas to include more flexible operation of a canopy thereof. It would be advantageous to provide canopy operation mechanisms that can positively control a configuration of the umbrella, such as the opening and closing of the canopy, independent of a state of elevation or tilt of the umbrella. It would be advantageous to provide canopy control from a position on a transverse member or boom, such that the canopy control is not mounted on an upright pole or slider mounted to travel on the upright pole.

In one aspect, an umbrella assembly includes an upright pole having a longitudinal axis; a canopy frame supported by the umbrella assembly in a cantilever manner by a cantilever beam; and an integrated mechanism configured to control multiple aspects of the umbrella assembly.

In some aspects of the umbrella assembly, the integrated mechanism is configured to control both opening and closing of the canopy frame and raising and lowering of the cantilever beam.

In some aspects of the umbrella assembly, the integrated mechanism is disposed on the upright pole.

In some aspects of the umbrella assembly, the integrated mechanism comprises a gear box, a crank, and a rack and pinion gear assembly to be coupled to the crank and configured to raise and lower the gear box and the cantilever beam.

In some aspects of the umbrella assembly, the integrated mechanism comprises a crank that in a first position controls an upward and downward motion of the cantilever beam and in a second position controls an opening and closing motion of the canopy frame.

In some aspects of the umbrella assembly, the integrated mechanism comprises a stepped shaft that is translatable relative to a drive or driven member such that at least one mechanism can be engaged and at least one can be disengaged depending on the position of a narrow section of the shaft relative to the drive or driven members.

In some aspects of the umbrella assembly, a drive gear disposed on a crankshaft is translatable relative to the longitudinal axis of the upright pole from a first position in which the drive gear disposed on the crankshaft engages a pinion gear to enable the integrated mechanism to raise or lower the canopy frame to a second position in which the drive gear disposed on the crankshaft engages a driven gear to enable the integrated mechanism to rotate a shaft having a spool mounted thereon, the spool coupled with a tension member to open and close the canopy frame.

In some aspects of the umbrella assembly, the drive gear is translatable to a third position in which the drive gear disposed on the crankshaft engages a peripheral gear coupled with the pinion gear and the driven gear to enable the integrated mechanism to simultaneously raise the canopy frame and open the canopy frame or to lower the canopy frame and to close the canopy frame.

In some aspects of the umbrella assembly, the drive gear is immovably mounted on the crankshaft and the crankshaft is translatable to move the drive gear between the first and second and optionally the third position.

In some aspects of the umbrella assembly, the umbrella assembly further includes a housing enclosing the integrated mechanism and wherein the drive gear is coupled with an actuator that extends through an aperture in the housing, the actuator and the drive gear slideably coupled with the crankshaft such that the actuator can be actuated to move the drive gear between the first and second and optionally the third position.

In some aspects of the umbrella assembly, the first position corresponds to a first aperture of the gear box and the second position corresponds to a second aperture of the gear box.

In some aspects of the umbrella assembly, the integrated mechanism further comprises an integrated clutch and tilt mechanism operable to rotate the canopy frame about an axis extending through the cantilevered beam, the integrated clutch and tilt mechanism including a first member rotatable with respect to a second member, the second member rotatable with the rotatable shaft and slidable with respect to the rotatable shaft from a locked position to an unlocked position, wherein when the second member is in the unlocked position the first and second members are rotatable with the shaft.

In some aspects of the umbrella assembly, the integrated clutch and tilt mechanism comprises a lever disposed at the second end of the rotatable shaft such that rotation of the lever drives rotation of the first member.

In some aspects of the umbrella assembly, the second member comprises an opening surrounding the rotatable shaft such that the first member can rotate relative to the shaft when the second member is in the locked position and can rotate the rotatable shaft when the second member is in the unlocked position.

In some aspects of the umbrella assembly, the opening comprises a first surface configured to act on the rotatable shaft to cause the shaft to rotate in a clockwise direction and a second surface configured to prevent rotation of the rotatable shaft in a counter-clockwise direction.

In yet another aspect, an umbrella assembly includes an upright pole having a longitudinal axis; a canopy frame supported by the umbrella assembly in a cantilever manner by a cantilever beam; and an integrated mechanism comprising a drive gear disposed in a housing configured to be coupled with a first mechanism to raise and lower the cantilever beam and to be coupled with a second mechanism to open and close the canopy frame.

In some aspects of the umbrella assembly, the drive gear is coupled with a crankshaft, the crankshaft and the drive gear having a first position within the housing in which the drive gear is coupled with a pinion gear of a rack and pinion assembly and rotation of the drive gear rotating the pinion gear raises and/or lowers the housing relative to the upright pole, the crankshaft and the drive gear having a second position within the housing in which the drive gear is coupled with the second mechanism to rotate a spool to wind or unwind a tension member coupled with the canopy frame.

In some aspects of the umbrella assembly, the crankshaft and the drive gear have a third position within the housing in which the drive gear drives both the first mechanism and the second mechanism.

In some aspects of the umbrella assembly, the drive gear is coupled with a crankshaft, the drive gear having a first position on the crankshaft in which the drive gear is coupled with a pinion gear of a rack and pinion assembly and second position relative to the drive shaft in which the drive gear is coupled with the second mechanism.

In some aspects of the umbrella assembly, the drive gear has a third position on the crankshaft in which the drive gear drives both the first mechanism and the second mechanism.

In some aspects of the umbrella assembly, a first aperture in the housing provides access for a crank to directly rotate a shaft of the first mechanism and a second aperture in the housing provides access for a crank to directly rotate a shaft of the second mechanism.

In yet another aspect, an umbrella assembly includes an upright pole; a cantilevered beam having a first end disposed away from the upright pole and a second end disposed adjacent to the upright pole; a canopy frame coupled with the first end of the cantilevered beam; and an integrated clutch and tilt mechanism operable to rotate the canopy frame about an axis extending through the cantilevered beam, the integrated clutch and tilt mechanism including a rotatable shaft disposed in the cantilevered beam, a first member rotatable with respect to a second member, the second member rotatable with the rotatable shaft and slidable with respect to the rotatable shaft from a locked position to an unlocked position; wherein when the second member is in the unlocked position the first and second members are rotatable with the shaft.

In some aspects of the umbrella assembly, the integrated clutch and tilt mechanism comprises a lever disposed at the second end of the cantilevered beam such that rotation of the lever drives rotation of the first member.

In some aspects of the umbrella assembly, the second member comprises an opening surrounding the rotatable shaft such that the first member can rotate relative to the shaft when the second member is in the locked position and can rotate the rotatable shaft when the second member is in the unlocked position.

In some aspects of the umbrella assembly, the opening comprises a first surface configured to act on the rotatable shaft to cause the shaft to rotate in a clockwise direction and a second surface configured to prevent rotation of the rotatable shaft in a counter-clockwise direction.

In another aspect, an umbrella assembly includes an upright pole having a longitudinal axis; a canopy frame supported by the umbrella assembly in a cantilever manner by a cantilever beam; and an integrated mechanism configured to control multiple aspects of the umbrella assembly.

In some aspects of the umbrella assembly, the integrated mechanism is configured to control both opening and closing of the canopy frame and raising and lowering of the cantilever beam.

In some aspects of the umbrella assembly, the integrated mechanism is disposed on the upright pole.

In some aspects of the umbrella assembly, the integrated mechanism comprises a gear box, a crank, and a rack and pinion gear assembly to be coupled to the crank and configured to raise and lower the gear box and the cantilever beam.

In some aspects of the umbrella assembly, the integrated mechanism comprises a crank that in a first position controls an upward and downward motion of the cantilever beam and in a second position controls an opening and closing motion of the canopy frame.

In some aspects of the umbrella assembly, the integrated mechanism comprises a stepped shaft that is translatable relative to a drive or driven member such that at least one mechanism can be engaged and at least one mechanism can be disengaged depending on the position of a narrow section of the shaft relative to the drive or driven members.

In some aspects of the umbrella assembly, a drive gear disposed on a crankshaft is translatable relative to the longitudinal axis of the upright pole from a first position in which the drive gear disposed on the crankshaft engages a pinion gear to enable the integrated mechanism to raise or lower the canopy frame to a second position in which the drive gear disposed on the crankshaft engages a driven gear to enable the integrated mechanism to rotate a shaft having a spool mounted thereon, the spool coupled with a tension member to open and close the canopy frame.

In some aspects of the umbrella assembly, the drive gear is translatable to a third position in which the drive gear disposed on the crankshaft engages a peripheral gear coupled with the pinion gear and the driven gear to enable the integrated mechanism to simultaneously raise the canopy frame and open the canopy frame or to lower the canopy frame and to close the canopy frame.

In some aspects of the umbrella assembly, the drive gear is immovably mounted on the crankshaft and the crankshaft is translatable to move the drive gear between the first and second and optionally the third position.

In some aspects of the umbrella assembly, the umbrella assembly further includes a housing enclosing the integrated mechanism and wherein the drive gear is coupled with an actuator that extends through an aperture in the housing, the actuator and the drive gear slideably coupled with the crankshaft such that the actuator can be actuated to move the drive gear between the first and second and optionally the third position.

In some aspects of the umbrella assembly, the first position corresponds to a first aperture of the gear box and the second position corresponds to a second aperture of the gear box.

In some aspects of the umbrella assembly, the integrated mechanism further comprises an integrated clutch and tilt mechanism operable to rotate the canopy frame about an axis extending through the cantilevered beam, the integrated clutch and tilt mechanism including a first member rotatable with respect to a second member, the second member rotatable with the rotatable shaft and slidable with respect to the rotatable shaft from a locked position to an unlocked position, wherein when the second member is in the unlocked position the first and second members are rotatable with the shaft.

In some aspects of the umbrella assembly, the second member comprises an opening surrounding the rotatable shaft such that the first member can rotate relative to the shaft when the second member is in the locked position and can rotate the rotatable shaft when the second member is in the unlocked position.

In some aspects of the umbrella assembly, the opening comprises a first surface configured to act on the rotatable shaft to cause the shaft to rotate in a clockwise direction and a second surface configured to prevent rotation of the rotatable shaft in a counter-clockwise direction.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Some umbrellas are supported from the side rather than from below. Such umbrellas are sometimes referred to as cantilever umbrellas. A cantilever umbrella will typically have a side support or upright pole and a boom, transverse bar or arm to hold the canopy above a space to be shaded. In smaller cantilever umbrellas, the transverse arm can be raised or lowered by hand. The canopy can be opened by a crank. In larger umbrellas an integrated mechanism as discussed below can be provided to raise and open an umbrella.

Figure 1:
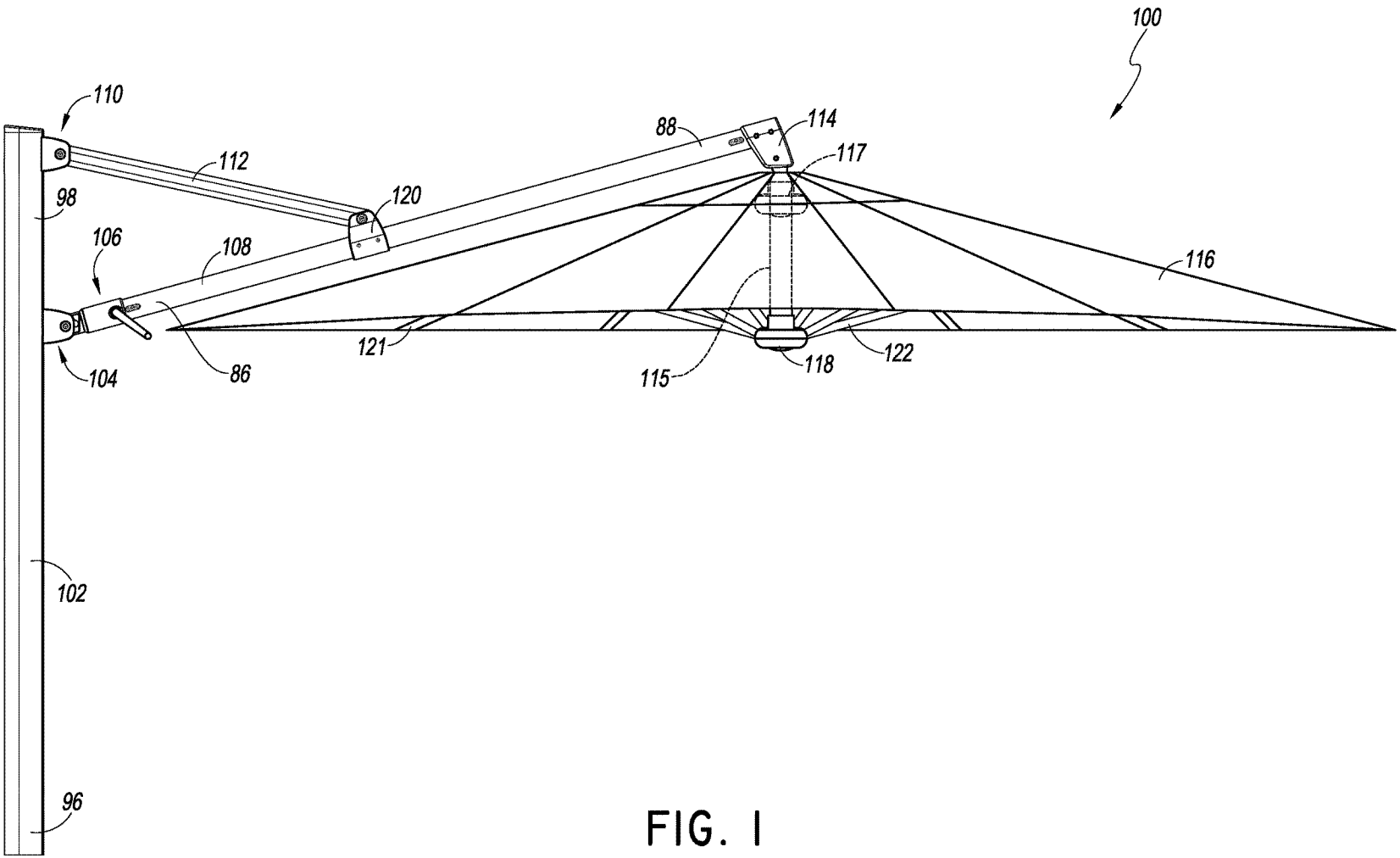
FIG. 1 is a side view of an embodiment of a cantilever umbrella assembly.
Figure 2:
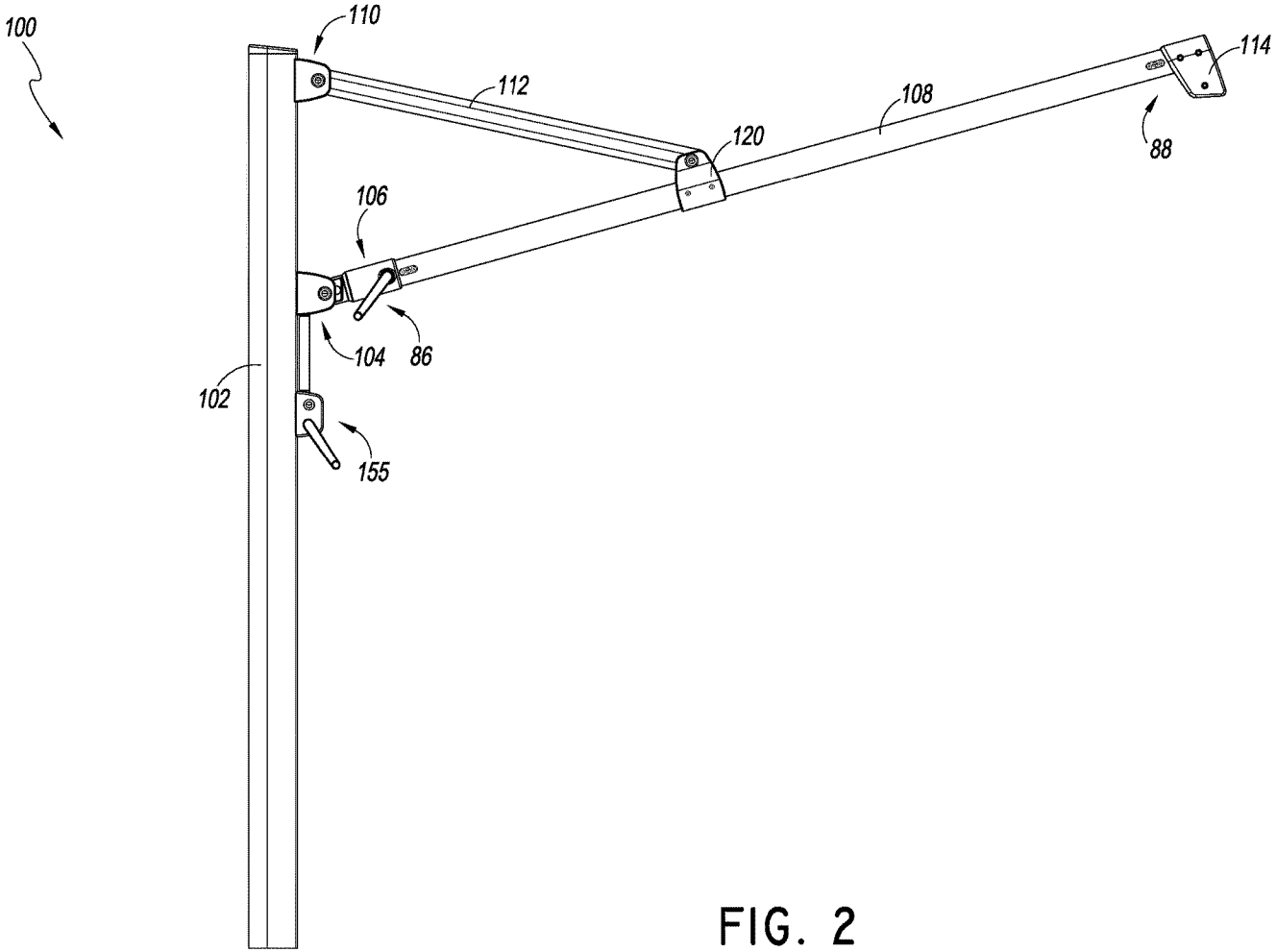
FIG. 2 is a side view of another cantilever umbrella assembly with an integrated mechanism for raising and lowering or extending and retracting a canopy of the umbrella.
Figure 3:
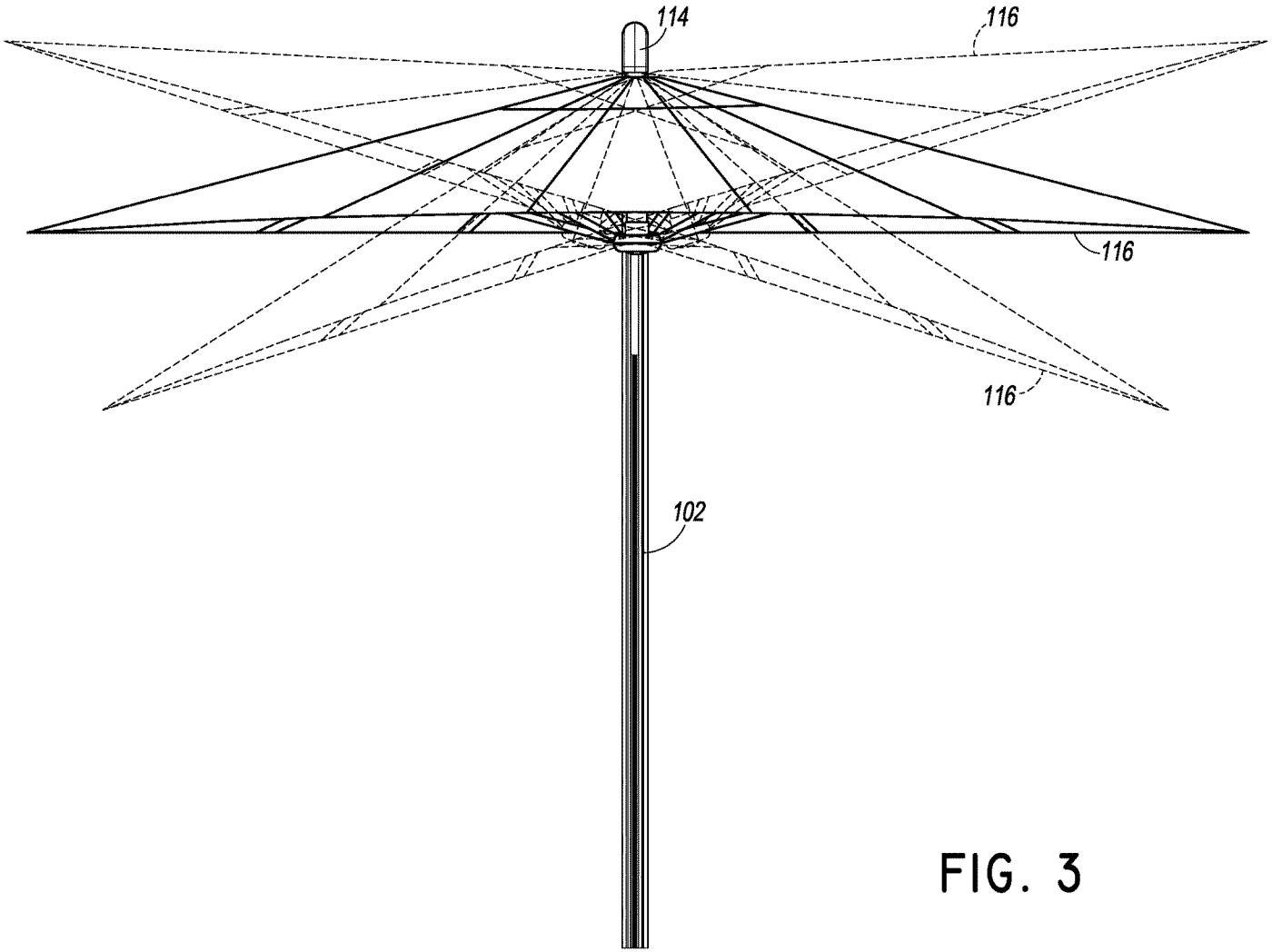
FIG. 3 is a front view of various tilt positions of a cantilever umbrella assembly.

FIGS. 1 and 2 illustrate some components of a cantilever umbrella 100 according to this application. The umbrella 100 includes a side support or upright pole 102 and a boom, transverse bar or arm cantilever beam 108 to hold a canopy frame 116 above a space to be shaded. In some embodiments, a support pole 112 can help support the boom 108, as discussed in greater detail below. The canopy frame 116 is coupled to the transverse arm 108 by a second umbrella frame shaft or pole 115 connected to a connection member 114. As discussed in greater detail below, a lower runner 118 is coupled with the pole 115 in a manner that permits the runner 118 to be drawn up into engagement with a lower end of the pole 115 or to travel up and down along a mid-section of the shaft or pole 115. The lower runner 118 is sometimes referred to as a hub. In some embodiments, the lower runner 118 separates from the pole 115 in the retracted or collapsed state of the umbrella 100. The runner 118 can be pulled into engagement with the lower end of the pole 115 when the umbrella 100 is extended. The umbrella 100 can be stowed when the runner 118 is in a lowered position. The canopy frame 116 can be level, e.g., horizontal, in an elevated position of the runner 118. In some embodiments, when the runner 118 is fully elevated the canopy frame 116 can be tilted as shown by the two dashed line images in FIG. 3.

In some embodiments, the umbrella assembly 100 comprises an upper runner or hub 117 with a plurality of ribs 121 extending outwardly thereof to form a portion of the canopy frame 116 which is used to support a cover of fabric or other suitable material. The umbrella assembly also includes the lower hub 118 having a plurality of struts 122 extending upwardly to the ribs. The lower hub 118 can translate or slide along or be pulled against a lower end of a shaft 115 that extends from the elbow or connection member 114. The upper hub 117 is preferably fixed to the shaft 115. As will be discussed in greater detail below, the shaft 115 may be tilted about an axis extending through the transverse arm 108.

The upright pole 102 has an upper portion 98 and a lower portion 96. The pole 102 is configured to be supported in an upright position by a base (not shown). The support pole 112 is connected to the upright pole 102 with a fixed connection member 110. The fixed connection member 110 is preferably configured to allow the support pole 112 to rotate up and down as a sliding connection member 104 moves up and down the pole 102. In some embodiments there may also be a sliding connection member or sleeve 120 that enables the outside surface of the transverse arm 108 to slide through the member 120. The transverse arm 108 is connected at a second end 86 to the upright pole 102 with the sliding connection member 104. The sliding connection member 104 is configured to slide vertically up and down the pole 102 as the outer or first end 88 of the transverse arm 108 is extended away from the upright pole 102.

A combined or integrated mechanism 106 is disposed within the end 86 of the transverse arm 108 adjacent to the upright pole 102. The integrated mechanism 106 can be configured to control multiple aspects of the umbrella 100, e.g., to control tile and clutch functions of the transverse arm 108. In some embodiments, the combined clutch and tilt mechanism 106 extends through the transverse arm 108 from the second end 86 to the first end 88. The combined clutch and tilt mechanism 106 may be operated by a handle disposed on the second end 86 of the transverse arm 108. Additional details of the combined clutch and tilt mechanism 106 will be discussed in detail with reference to FIGS. 4 and 5 below.

As shown in FIG. 2, an integrated deployment mechanism 155 for opening/closing the canopy frame 116 and extending/retracting the transverse arm 108 is moveably attached to the upright pole 102 such that the integrated deployment mechanism 155 can move, e.g., slide, up and down the upright pole 102 as the transverse arm 108 is extended and retracted. As discussed in greater detail below, the transverse arm 108 can be extendable (e.g., slideable) through a collar or sliding member 120 between extended and retracted configurations. The extended configuration generally corresponds to an open position of the canopy frame 116. The retracted configuration generally corresponds to a closed position of the canopy frame 116.

Clutch and Tilt Mechanism

Figure 4:
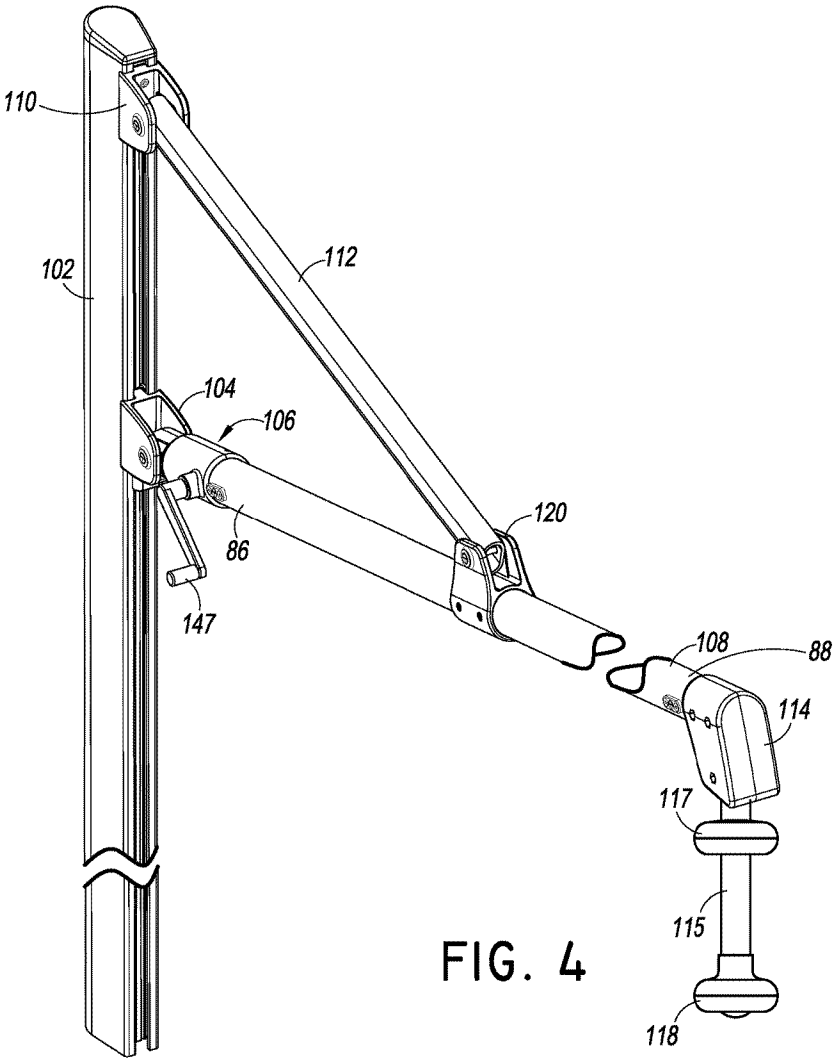
FIG. 4 is a front perspective view of frame components of a cantilever umbrella assembly.
Figure 5:
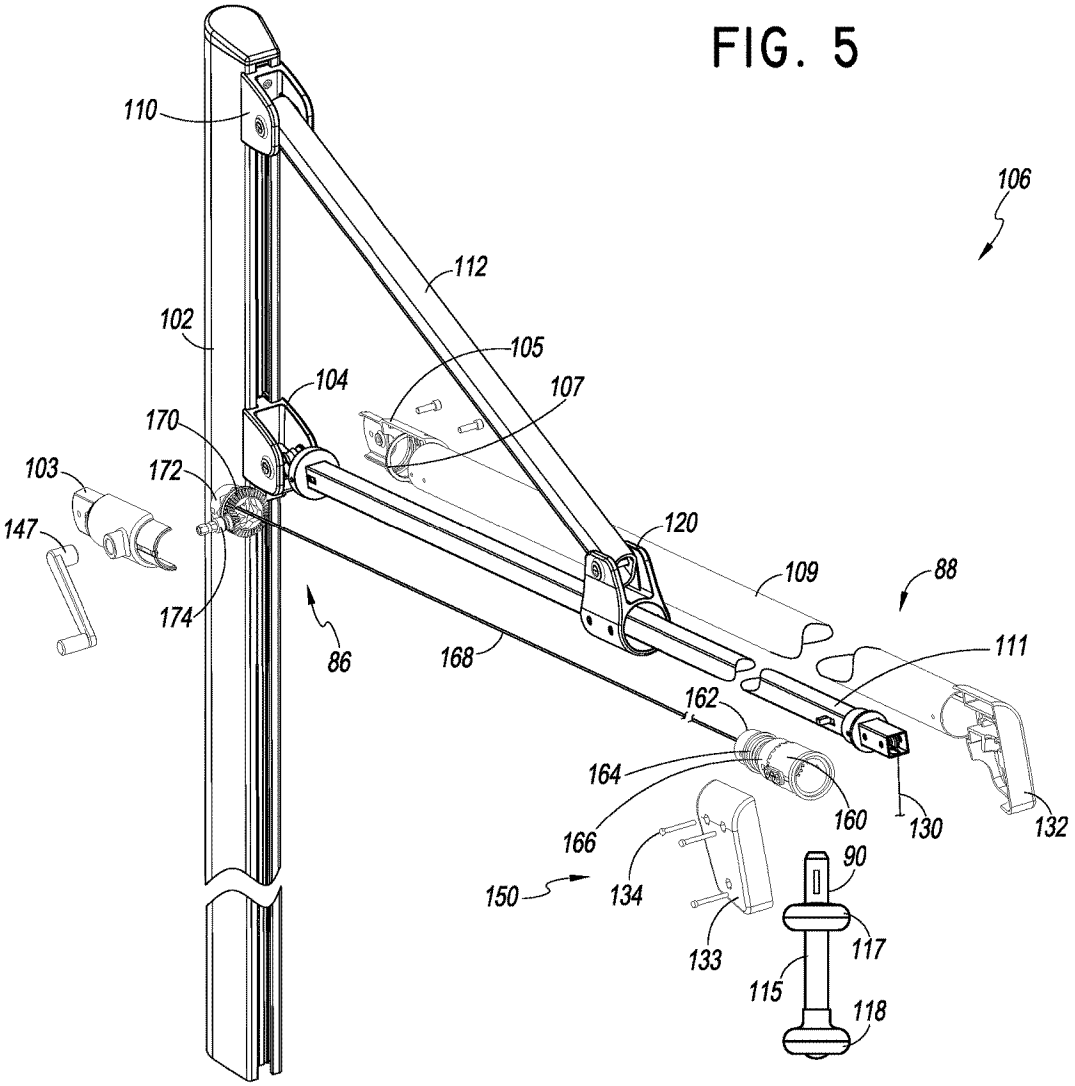
FIG. 5 is a partially exploded view of an embodiment of a cantilever umbrella assembly.

FIGS. 4 and 5 illustrate features of a clutch and tilt mechanism 106. The tilt mechanism 106 is disposed adjacent to or at the second end 86 of the transverse arm 108. The tilt mechanism 106 is actuated adjacent to or at the second end 86 of the transverse arm 108 to rotate the canopy frame 116 at the first end 88 of the transverse arm 108 remotely. Rotation of the crank handle 147 actuates rotation of an elongate member 111 (e.g., shaft) that extends through the transverse arm 108 from the first end 88 to the second end 86. Rotation of the crank handle 147 drives rotation of the elongate member 111, the elbow 114, and the shaft 115, and thereby the canopy along with the elbow 114. As shown most clearly in FIG. 3, rotation of the canopy frame 116 may be about an axis extending through the transverse arm 108 such that the canopy frame 116 tilts from side to side, as viewed from a front position.

Figure 7:
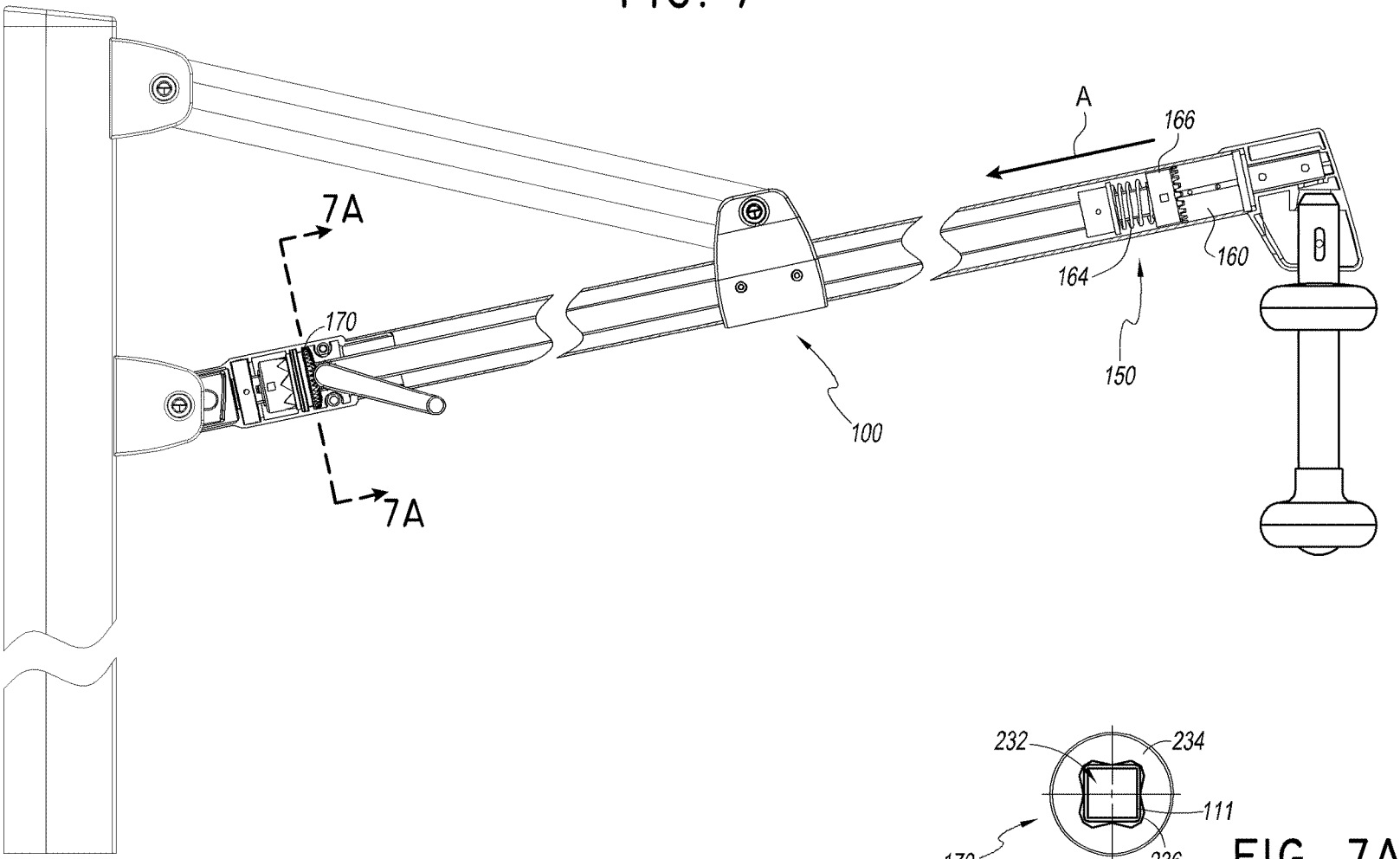
FIG. 7 is a partial cross-section view of a cantilever beam illustrating some internal components of an integrated tilt and clutch mechanism of a cantilever umbrella assembly.
Figure 7A:
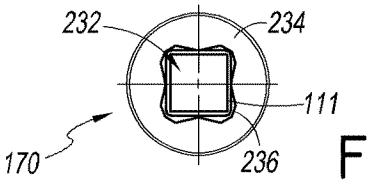
FIG. 7A is a cross-sectional view of a tilt component of an integrated tilt and clutch mechanisms of a cantilever umbrella assembly.

The elongate member 111 has a channel 232 formed therein (see FIG. 7A). The transverse arm 108 includes a housing 109 that is disposed about the elongate member 111. Rotation of the elongate member 111 causes rotation of the canopy frame 116. The housing 109 is not rotatable but is stationary in embodiments.

The combined tilt and clutch mechanism 106 actuates a device that moves the canopy frame 116 through a range of tilt positions and maintains the canopy in any selected tilt position. The tilt and clutch mechanism 106 includes or is coupled with a clutch assembly 150 disposed within or adjacent to the first end 88 of the transverse arm 108. The tilt and clutch mechanism 106 can also include an actuator disposed adjacent to the second end 86 of the transverse arm 108. The clutch assembly 150 preferably includes an end member 162, a spring 164, a first locking component 166, and a second locking component 160 disposed adjacent to the first end 88 of the transverse arm 108. The tilt and clutch mechanism 106 also includes a tension member 168 (e.g., cable, rod, etc.) disposed within the channel 232 of the elongate member 111. FIG. 7 shows an arrow A that indicates movement of the clutch assembly 150 from an engaged or locked position (as shown) to a disengaged or unlocked position (not shown). More particularly, rotation of the crank handle 147 causes a tension force in the tension member 168. The tension force urges the first locking component 166 out of engagement with the second locking component 166. For example, teeth of the locking components 166, 160 that can be overlapping in a plane transverse to the transverse arm 108 and thus in the engaged or locked position can be moved to not overlap in a plane transverse to the transverse arm 108 and thus be disengaged by this movement. The spring 164 can help the locking component 166, 160 to return to a locked position. Additional details of some components of the combined tilt and clutch mechanism 106 may be found in U.S. patent application Ser. No. 13/797,156, filed Mar. 12, 2013, entitled "CANTILEVER UMBRELLA," the entirety of which is incorporated by reference herein.

In some embodiments, the second locking component 160 is fixed to the housing 109 of the transverse arm 108 adjacent to the first end 88. The first locking component 166 is slidable over the elongate member 111 (e.g., shaft) between a locked position and an unlocked position. When the first locking component 166 is in the unlocked position the first locking component 166 is rotatable with the elongate member 111. Disengagement of the first locking component 166 from the second locking component 160 may be accomplished through rotation of the crank 147, located at the first end of the transverse arm 108, as is discussed in further detail below.

FIG. 5 shows that the integrated clutch and tilt mechanism 106, together with the clutch assembly 150, unlocks the locking components 166, 160, and tilts the canopy of the umbrella. The clutch and tilt mechanism 106 is preferably incorporated into the second end 86 of the transverse arm 108 disposed away from the canopy frame 116 such that it may be easily manipulated by the user. The clutch and tilt mechanism 106 comprises a plurality of gears engaged with the elongate member 111. The gears are enclosed within the housing 109 of the transverse arm 108. The elongate member 111 is coupled with the canopy frame 116 by the clutch assembly 150 disposed adjacent to or within the first end 88 of the transverse arm 108. In some embodiments, the clutch and tilt mechanism 106 includes a first portion (e.g., including the elongate member 111) and a second portion (e.g., including the shaft 115). The first portion extends through the housing 109 of the transverse arm 108 to a first end 90 of the shaft 115. The first end 90 of the shaft 115 can be rotatably coupled with the connection member or elbow 114. The first end 90 of the shaft 115 can be coupled with the connection member or elbow 114 to rotate in unison about the longitudinal axis of the transverse arm 108. Rotation of the crank 147 causes rotation of the elongate member 111 which drives rotation of the shaft 115 indirectly by rotating the elbow 114.

As further illustrated in FIG. 5, the clutch and tilt mechanism 106 includes a first tilt component 170, a second tilt component 172, and the crank 147 disposed adjacent to or within the second end 86 of the transverse arm 108. The first and second tilt components 170, 172 are located within a shell housing 113 having a first half 103 and a second half 105. In the illustrated embodiment, the shell housing 113 has two sides, each enclosing roughly equal portion of the perimeter. In other embodiments, the shell can have portions of different sizes. The housing also includes an optional bearing component 107 that may provide additional spacing or cushioning for the clutch components. The bearing component 107 may provide a friction reducing function by being formed of a thermoplastic material with low friction, such as polyoxymethylene, sold under the brand name Delrin®.

An actuation gear 174 may be coupled to the crank handle 147 such that rotation of the crank 147 causes rotation of the gear 174 which in turn rotates the first tilt component 170 by engaging with a meshing interface on the first tilt component 170. Rotation of the crank handle 147 actuates the first tilt component 170 to rotate relative to the second tilt component 172 and thereafter to rotate about an axis extending through the transverse arm 108.

Rotation of the first tilt component 170 causes the second tilt component 172 to translate away from the first tilt component 170 and disengage or release the clutch assembly 150, as discussed above and in greater detail below. As the first tilt component 170 rotates, the second tilt component 172 is pushed away or translated away from the first tilt component 170. The translation of the second tilt component 172 away from the first tilt component causes the tension member 168 to apply force to the first locking component 166. The tension member 168 pulls the first locking component 166 away from the second locking component 160 such that the first locking component 166 translates away from the second locking component 160. The translation of the first locking component 166 away from the second locking component 160 causes the canopy 166 to move to a disengaged position adjacent to the elbow member 114. As the first locking component 166 disengages from the second locking component 160, additional rotation of the crank 147 causes the elongate member 111 to rotate within the housing 109 of the transverse arm 108, causing the canopy frame 116 to tilt. The tilting enables the canopy frame 116 to be placed in the dashed line positions shown in FIG. 3. As will be discussed in greater detail below, because the first tilt component 170 and the second tilt component 172 have an interface comprising meshed teeth, as shown in FIG. 6, and a simultaneously actuated clutch assembly 150 instead of a worm gear, the tilt of the canopy can be maintained without the use of a worm gear, thus providing greater flexibility in gear choice.

Figure 6:
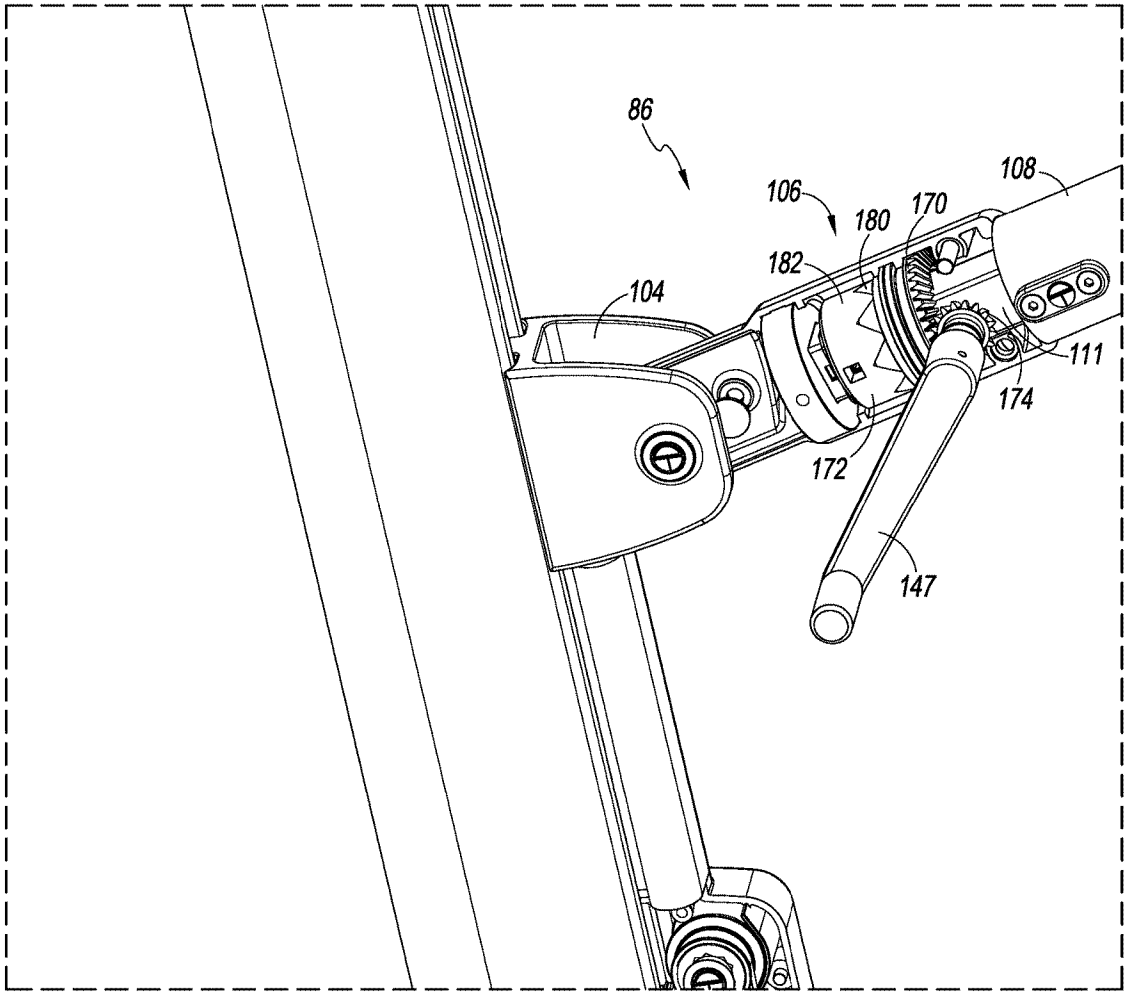
FIG. 6 is a detailed view of an integrated clutch and tilt mechanism for a cantilever umbrella assembly.

A detailed view of the integrated clutch and tilt mechanism 106 disposed at the second end 86 of the transverse arm 108 is shown in FIG. 6. As discussed above, rotation of the crank handle 147 actuates the gear 174 that is engaged with the first tilt component 170. As the first tilt component 170 rotates, the interface 180 of the first tilt component 170 bear against the interface 182 of the second tilt component 172, causing the second tilt component 172 to move, e.g. to slide relative to the elongate member 111, away from the canopy frame 116. As the second tilt component 172 slides away from the canopy frame 116, the clutch assembly 150 located adjacent to or within the first end 88 of the transverse arm 108 is actuated to a disengaged configuration. Further rotation of the crank handle 147 causes the first tilt component 170 to apply rotational force to the elongate member 111 such that the elongate member 111 and the first tilt component 170 rotate together to the tilt the canopy frame 116.

During a first phase of actuation of the crank 147, the gear 174 engages and rotates the first tilt component 170. During the first phase of actuation, the pole 111 is stationary and does not rotate about an axis extending through the transverse arm 108. The first phase of actuation is focused on translating the first locking component 166 of the clutch assembly 150 to the unlocked or disengaged position. When the first locking component 166 is in the unlocked or disengaged position, a second phase of actuation of the crank 147 allows the pole 111 to rotate.

Figures 8, 8A:
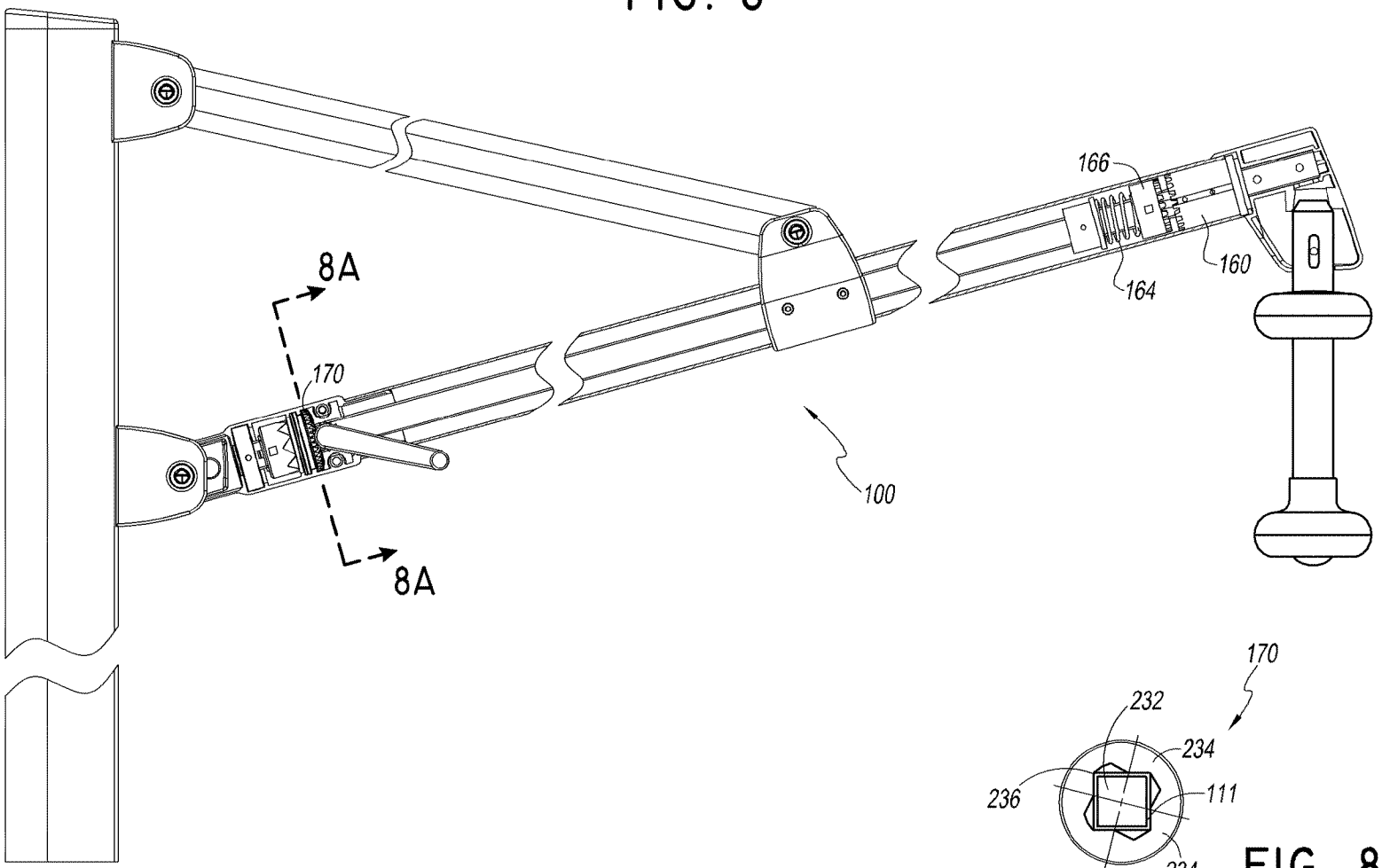
FIG. 8 is another partial cross-section view of a cantilever beam illustrating some components of an integrated tilt and clutch mechanism of a cantilever umbrella assembly.
FIG. 8A is another cross-sectional view of a tilt component of an integrated tilt and clutch mechanisms of a cantilever umbrella assembly.

Delaying the rotation of the elongate member 111 until the second tilt component 172 has disengaged the clutch assembly 150 is due to the configuration of the first tilt component 170, as shown in FIGS. 7A and 8A. The first tilt component 170 includes a first planar or convex surface 234. A series of surfaces 236 define an opening 232 in the surface 234. The surfaces 236 form a "flower" shape that is configured to interact with the square cross section of the elongate member 111 when the first tilt component 170 has rotated a specified number of degrees, such as about 15-50 degrees, about 25-30 degrees, or about 30-45 degrees. Initial rotation of the crank handle 147 in a first direction when the clutch assembly 150 is in an engaged configuration causes the first tilt component 170 to bear against the second tilt component 172 and disengage the clutch assembly 150 as discussed above. During this initial rotation of the first tilt component 170, the first tilt component 170 rotates about an axis defined by the transverse arm 108 and rotates around the elongate member 111. Once the first tilt component 170 has rotated through a specified angle or number of degrees, the surfaces 236 bear against the outer surface of the elongate member 111, causing the elongate member 111 to rotate with the first tilt component 170, which in turn causes the canopy to tilt.

FIG. 7A illustrates the position of the elongate member 111 within the opening of the first tilt component 170 when the surfaces 236 are not acting on the elongate member 111. In this position, the first tilt component 170 is rotatable with respect to the elongate member 111 prior to engaging the surfaces 236 with the outer surface 111 of the elongate member to drive rotation of the elongate member 111. During the phase of rotation when the surfaces 236 are not in engagement with the elongate member 111 the clutch assembly 150 is being actuated by the translation of the second tilt component 172. Contact between the surfaces 236 and the elongate member 111 preferably is delayed until or after the clutch assembly 150 is fully disengaged. Where the clutch assembly 150 includes mating gears that are slideably disengaged, contact between the surfaces 236 and the elongate member 111 occurs when or after the peaks of the gears are separated along the longitudinal axis of the elongate member 111.

Figure 10:
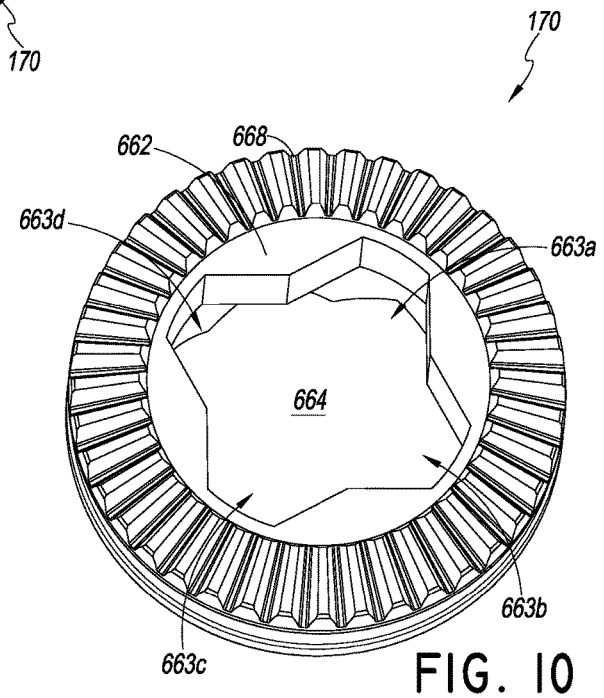
FIG. 10 is another front perspective view of the tilt component of FIG. 9.
Figure 11:
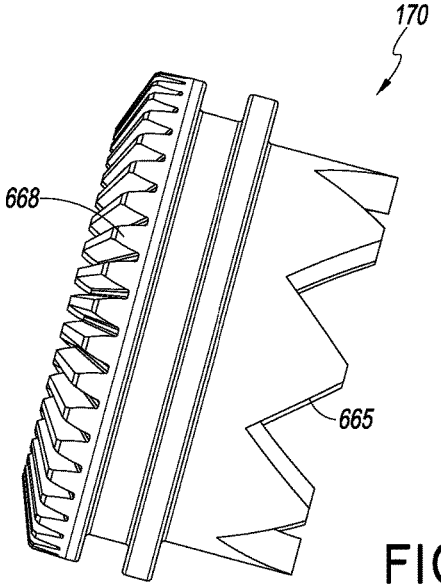
FIG. 11 is a side view of the tilt component of FIG. 9.
Figures 12, 12A:
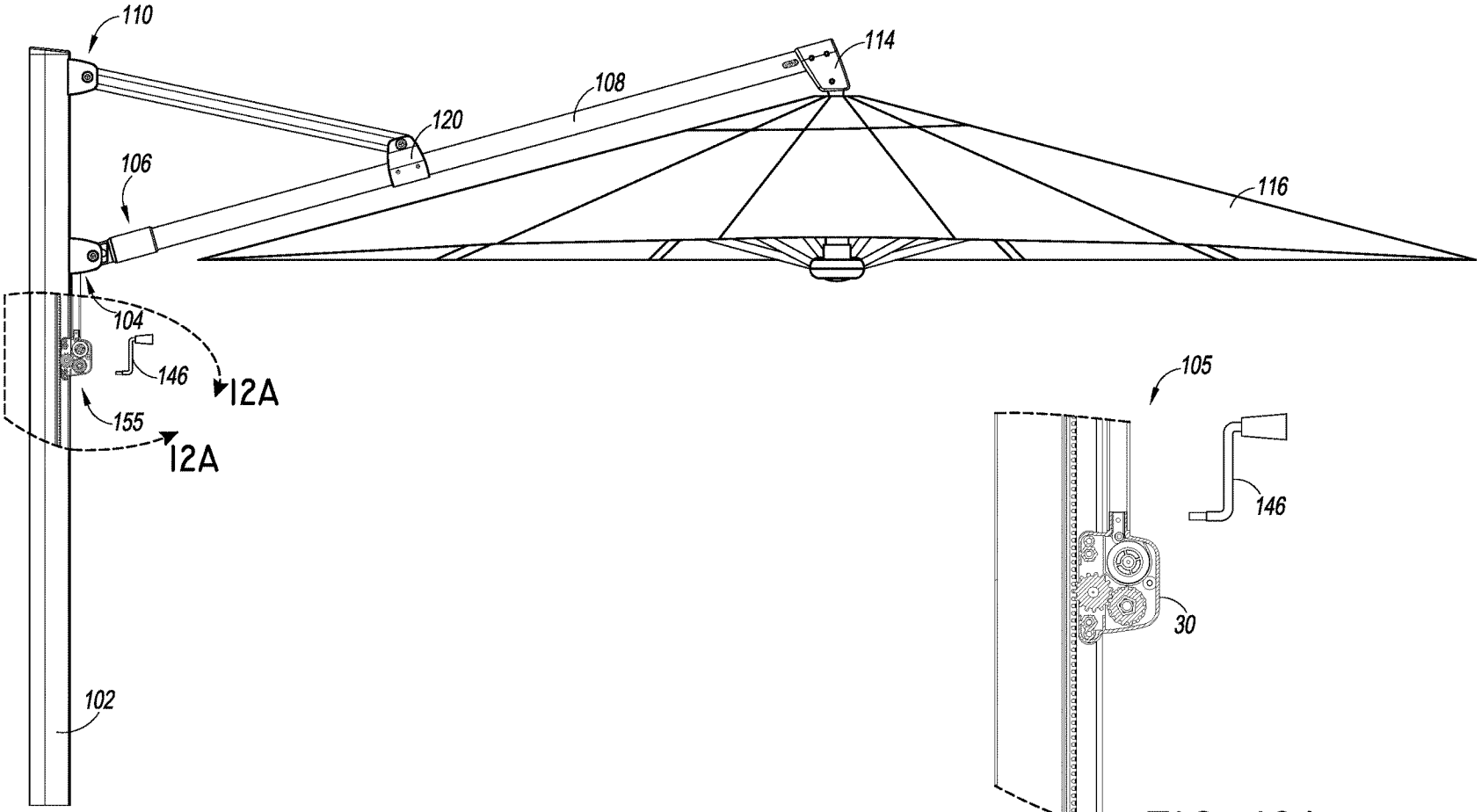
FIG. 12 is another side view of a cantilever umbrella assembly showing greater detail of one embodiment of an integrated deployment mechanism.
FIG. 12A is a detailed view of a portion of an integrated deployment mechanism.

A detailed view of one embodiment of an embodiment of the first tilt component 170 is shown in FIGS. 10-12. As illustrated, the first tilt component 170 includes a first surface 662. The first surface 662 may be planar or convex and may be disposed lower than engagement surfaces 668 formed on one side of the tilt component 170. The engagement surfaces 668 are preferably configured to engage with a gear driven by a crank handle, such as the gear 174 driven by the crank handle 147 shown in FIG. 6. A plurality of surfaces 670 form a "flower" shaped opening 664 in the surface 662. The opening 664 has four lobes 663*a*, 663*b*, 663*c*, and 663*d* that extend away from the center of the opening 664. The four lobes 663*a*, 663*b*, 663*c*, and 663*d* are configured to accommodate the four corners of a polygonal member, such as the elongate member 111. The member 111 is illustrated as having a square cross-section, but can be rectangular, oval or other non-round shape. The opening 664 is preferably configured to allow free rotation of the component 170 around the elongate member 111 for a specified number of degrees until the surfaces 670 of the lobes 663*a*, 663*b*, 663*c*, and 663*d* come into contact with the outer surface of the elongate member 111. The lobes 663*a*, 663*b*, 663*c*, and 663*d* may be of any shape to allow the component 170 to rotate around the elongate member 111 until the outer surface of the elongate member 111 comes into contact with the surfaces 670.

Figure 9:
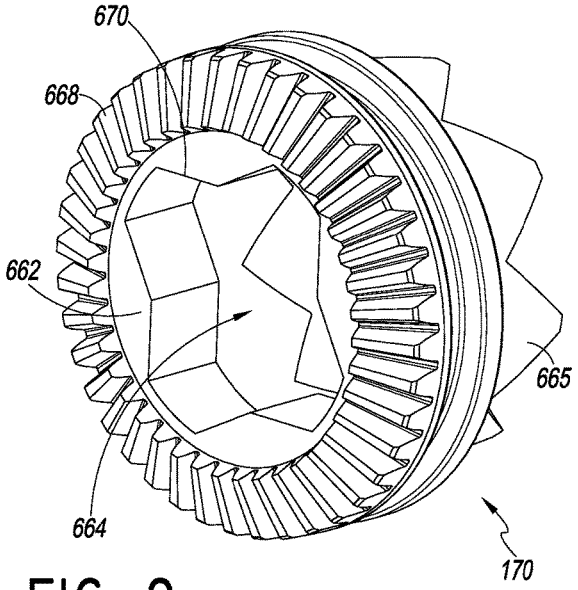
FIG. 9 is a front perspective view of one embodiment of a tilt component for a cantilever umbrella assembly.

With further reference to FIGS. 9-11, a plurality of engagement surfaces 665 extend from an opposite side of the component 170 from the engagement surfaces 668. The engagement surfaces 665 are configured to engage with corresponding engagement surfaces of the second tilt component 172. When the surfaces 670 contact the outer surface of the elongate member 111, further rotation of the component 170 also causes rotation of the elongate member 111. The number of rotational degrees through which the component 170 may rotate prior to engaging with the outer surface of the elongate member 111 preferably coincides with the number of rotational degrees needed to push the second tilt component 172 away from the first tilt component 170 as discussed above.

Integrated Mechanism with Movable Contoured Shaft

FIGS. 12-26 provide additional detail on the integrated deployment mechanism 155, which in some embodiments provides a mechanism for activating the canopy frame 116 from a closed to an open position, to raise and lower the cantilever beam or transverse arm 108, or to both open and close the canopy and to raise and lower the cantilever beam.

Figure 13:
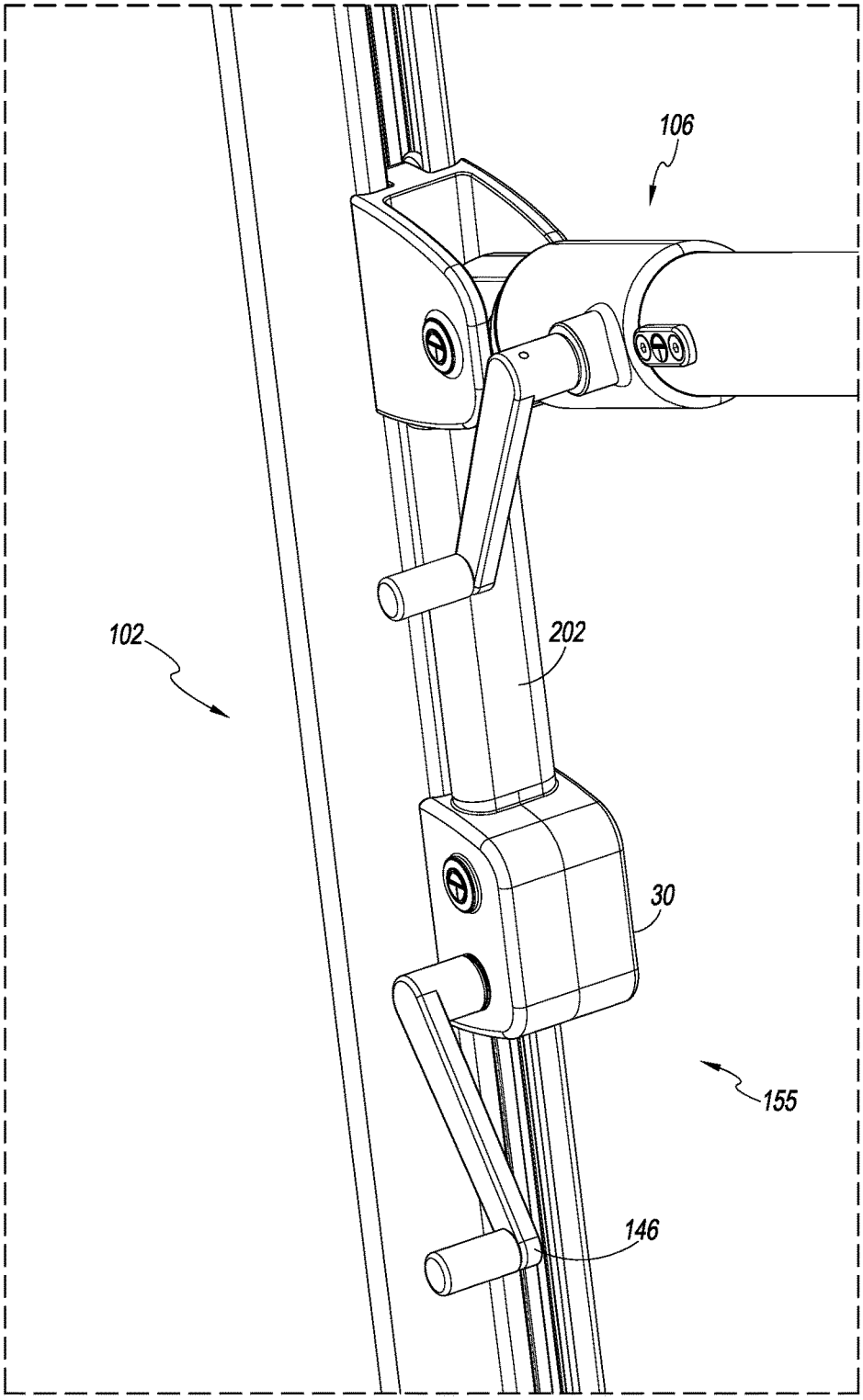
FIG. 13 is a detailed view of an integrated deployment mechanism for a cantilever umbrella assembly.
Figure 14:
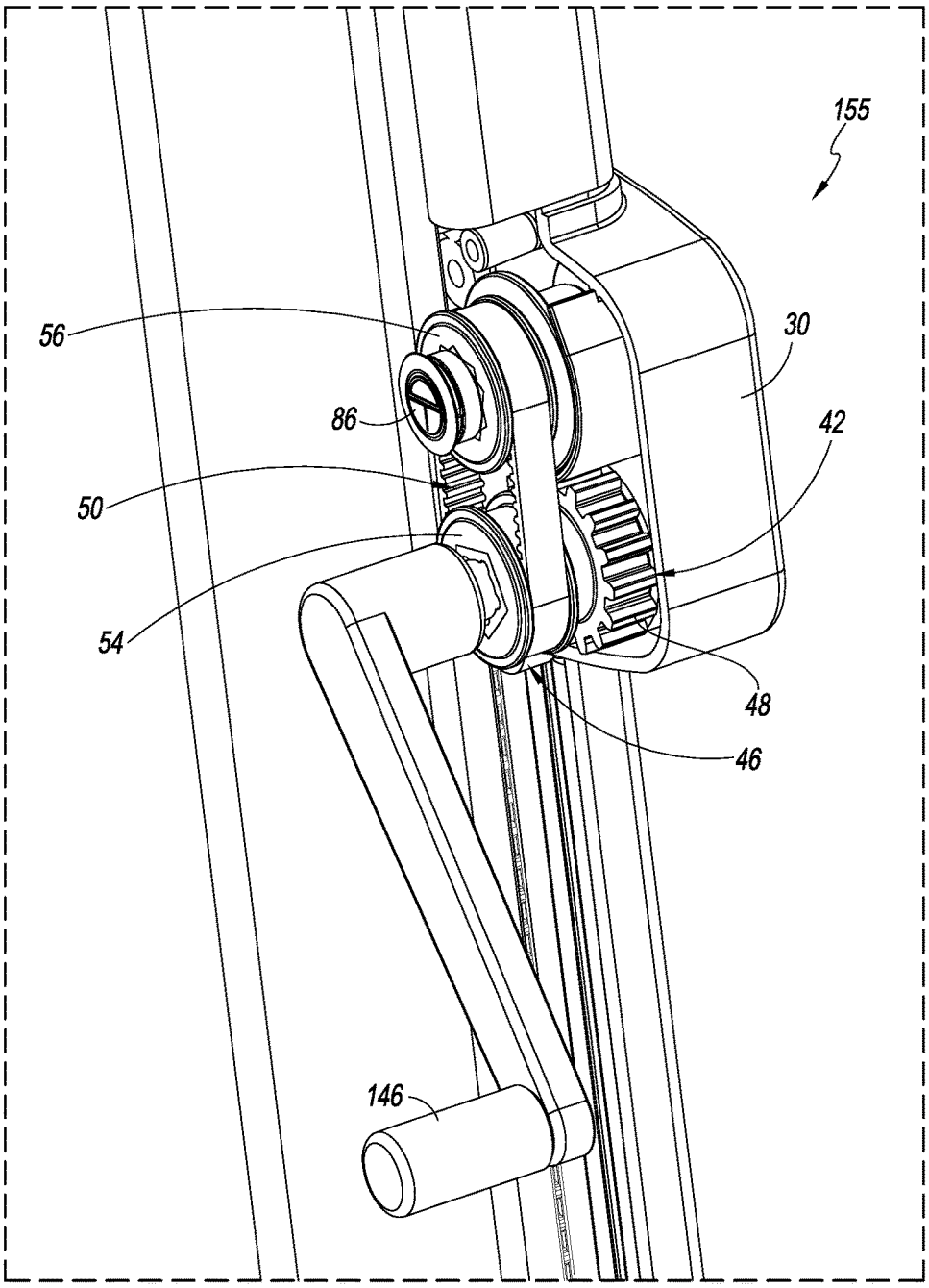
FIG. 14 is a view similar to that of FIG. 13 with a housing cover removed to show internal components of the integrated deployment mechanism.

In some embodiments, such as the embodiment shown in FIGS. 12-14, the integrated mechanism 155 includes a gear box or housing 30 that is positioned on a pole disposed within the upright pole 102. The housing 30 includes a first mechanism 42 to raise and lower the transverse arm 108 (and canopy) and a second mechanism 46 to open and close the canopy. As shown in FIG. 13, the integrated deployment mechanism 155 may be attached to a support member 202 that is rotatably connected to the sliding connection member 104. The crank 146 may be shifted along the axis defined by a shaft assembly 49 to engage either the first mechanism 42 to raise and lower the transverse arm 108 or the second mechanism 46 to open and close the canopy frame 116. When the crank 146 is in the first configuration, as discussed in greater detail below, rotation of the crank 146 causes the housing 30 and the support member 202, as well as the sliding connection member 104 to travel vertically up and down the upright pole 102. The vertical movement of the sliding connection member 104 causes the transverse arm 108 to extend away from the upright pole 102. When the crank 146 is in the second configuration, as discussed in greater detail below, rotation of the crank 146 causes the umbrella canopy to open and close.

Figure 15:
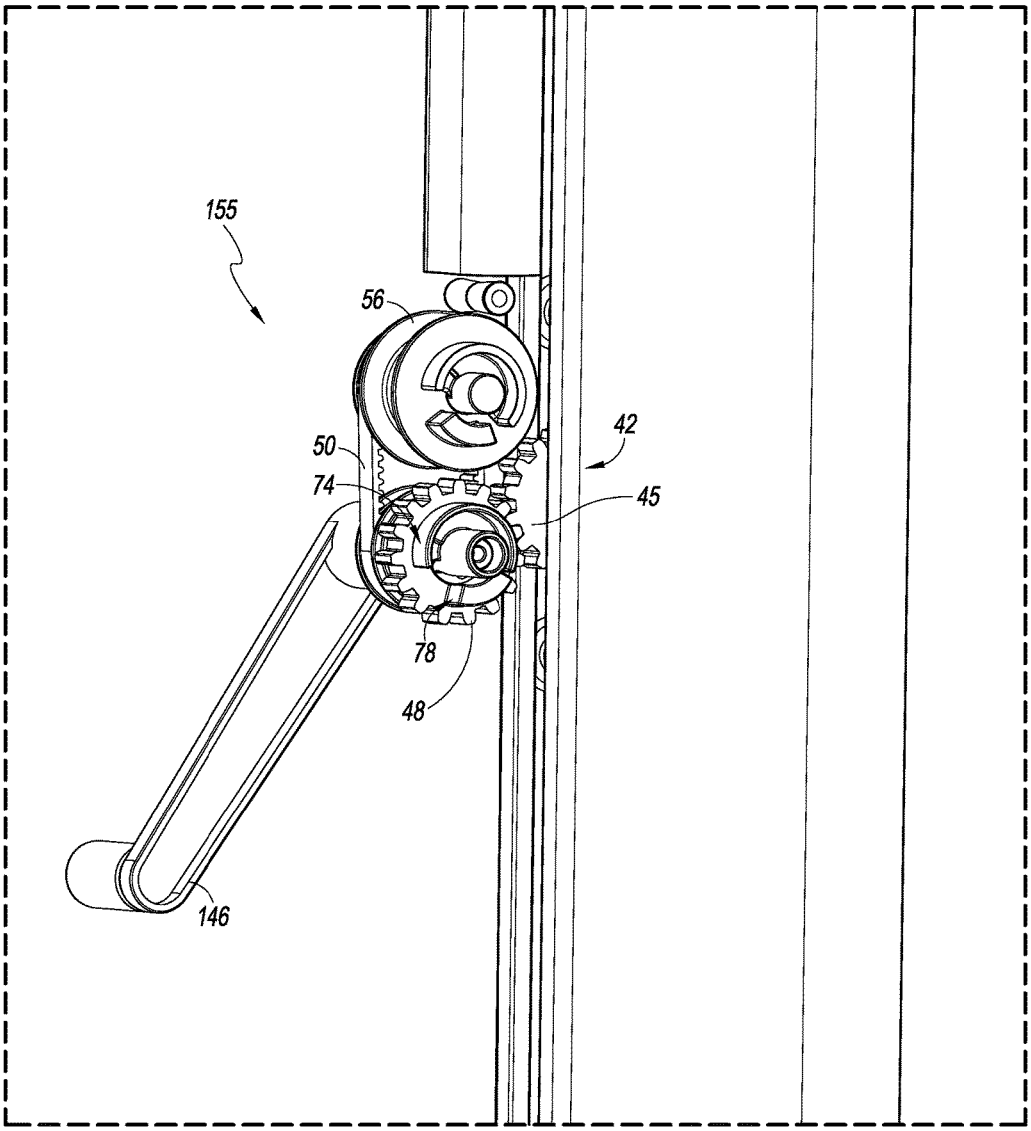
FIG. 15 is another view of an integrated deployment mechanism for a cantilever umbrella assembly.

Within the gear box 30, as shown in FIGS. 14 and 15, are the components of the first mechanism 42 and the second mechanism 46. The first mechanism 42 includes a first gear 48 and a second gear 45. The pair of gears can operate on a gear rack mounted vertically in the support or upright pole 102. The drive gear 48 can be coaxially mounted on a shaft assembly 49 coupled with the crank 146. When combined with a rack or gear chain 152, rotation of the crank 146 in the first configuration, that is engaged furthest to the right, causes the gear box 30 to travel vertically upward and downward along the upright pole 102. In some embodiments, the rack and piston arrangement may have mechanical advantage, such as a 2:1 gear ratio. The second mechanism 46 may include a drive sheave 54 and a driven sheave 56 coupled with a transmission belt 50. The driven sheave 56 includes a spool 86 around which a tension member (cord or cable), such as the tension member 130, may be wound or unwound to open and close the canopy. The drive sheave 54 can be coaxially mounted on the shaft assembly 49 coupled with the crank 146. As discussed in greater detail below, in some embodiments, the crank 146 may be moved to a first position such that rotation of the crank 146 rotates the first and second gears such that the crank box 146 and the transverse arm 108 move up and down along the upright pole 102. When the crank 146 is move to a second position, rotation of the crank 146 causes the rolling wheel and reel to open and close the umbrella.

Figure 19A:
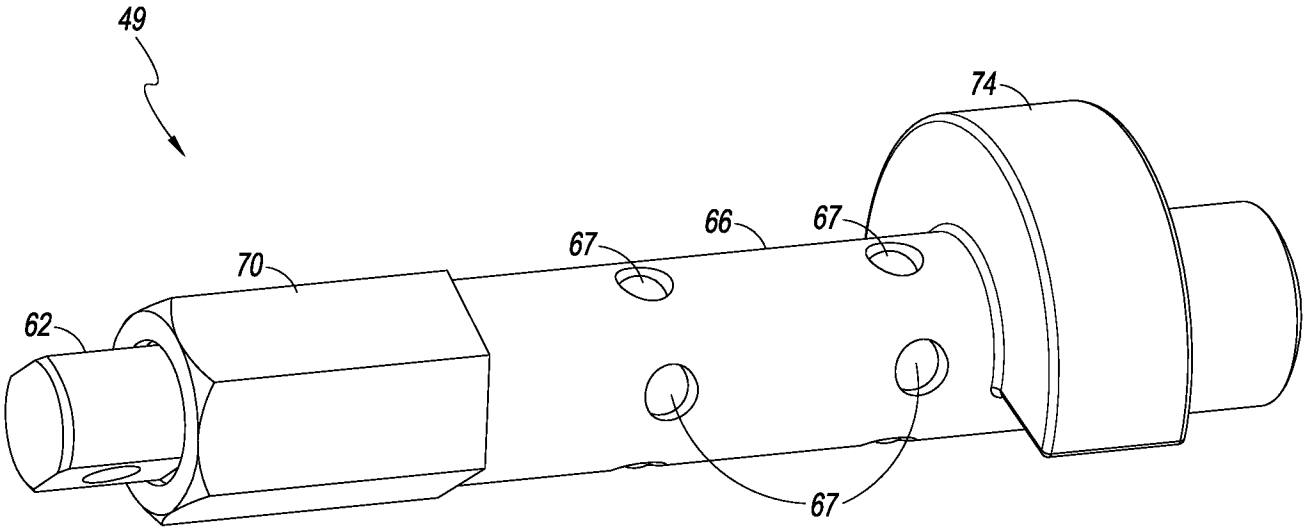
FIG. 19A is a view of a transmission component of an integrated deployment mechanism for an umbrella assembly.
Figure 19B:
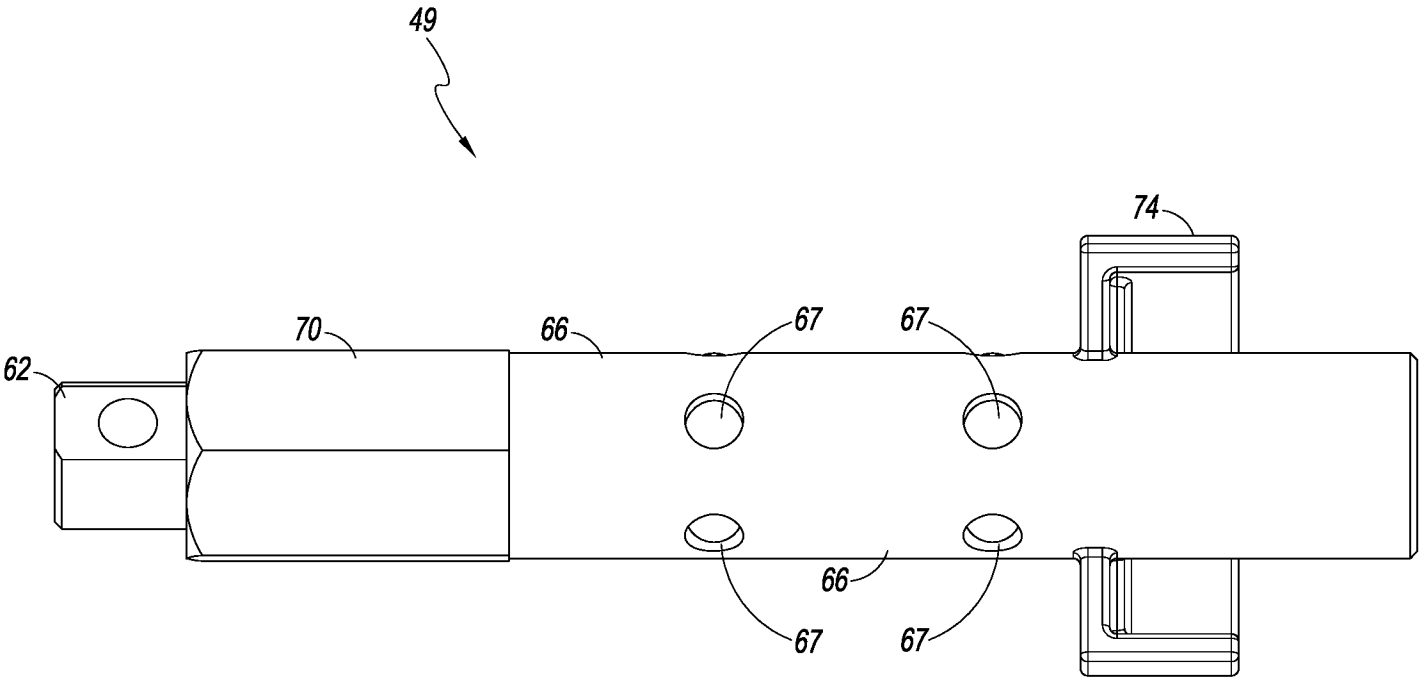
FIG. 19B is another view of the transmission component illustrated in FIG. 19A.

The crank 146 is connected to the shaft assembly 49. As shown in FIGS. 19A and B, the shaft assembly 49 has an inner shaft 62, an outer sleeve 66, and a plurality of bearings B disposed between the inner shaft and the outer sleeve. The shaft assembly 49 also includes a semicircular peripheral member 74 that extends from the exterior surface of a sleeve 66 of the shaft assembly 49. The peripheral member 74 extends around at least a partial circumference of the exterior surface of the sleeve 66. The inner shaft 62 has two reduced diameter sections 82 and 84 (see FIGS. 22 and 23) where the bearings B can shift radially inwardly to not protrude from the sleeve 66. When not in the reduced diameter sections 82 and 84, the bearings B protrude from the sleeve 66 through openings 67 in the sleeve 66. The openings 67 are desirably separated into two groups. One group of openings is spaced around the circumference of the sleeve 66 at a position closer to the crank 146 and the second group of openings 67 is spaced around the circumference of the sleeve 66 at a position closer to a peripheral member 74. When protruding from the sleeve 66, the bearings B engage axial slots 75 in drive components 70 disposed coaxially about the outer sleeve 66 (see FIG. 25).

Figure 16:
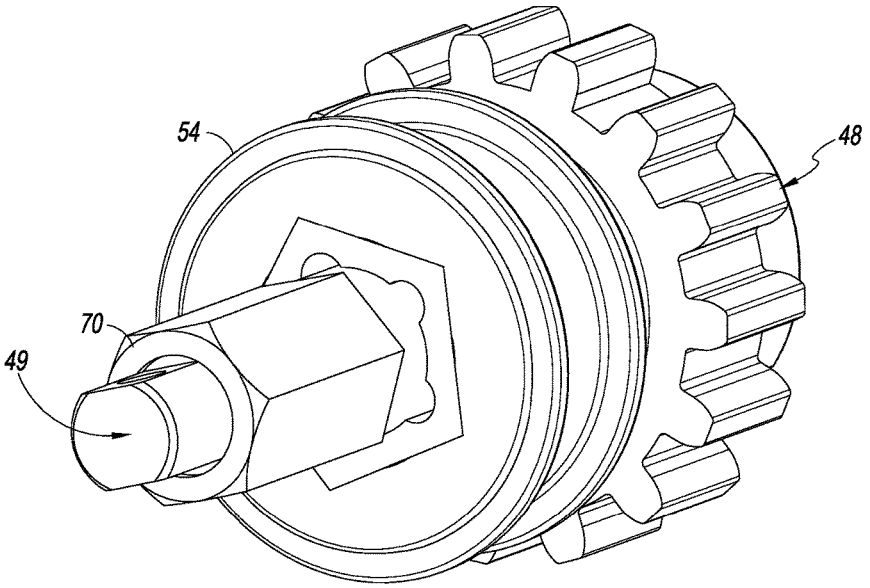
FIG. 16 is a view of a drive component of an integrated deployment mechanism for an umbrella assembly used to raise and/or lower the umbrella.

As best illustrated in FIGS. 15 and 16, the drive gear 48 is coaxially mounted on the shaft assembly 49 coupled with the crank 146. The drive gear 48 is configured to mesh or mate with a pinion gear 45 of a rack and pinion gear system. In order to drive the rotation of the first gear 48, as the crank 146 turns the shaft assembly 49, the peripheral member 74 abuts against a protrusion 78, shown in FIGS. 15 and 17, that is formed as part of the drive gear 48. As the peripheral member 74 pushes the protrusion 78, the drive gear 48 rotates, in turn rotating the driven gear 45. The driven gear 45 interacts with the rack and pinion system best shown in FIG. 26 to allow the transverse arm 108 move up and down along the upright pole 102.

The second mechanism 46 to open and close the canopy is now discussed with reference to FIGS. 14 and 20. As discussed above, the second mechanism 46 includes a drive sheave 54 coaxially mounted on the shaft assembly 49 coupled with the crank 146. The drive sheave 54 is coupled to the driven sheave 56 by a transmission belt 50. The driven sheave 56 includes the spool 86 around which a tension member (cord or cable), such as the tension member 130, may be wound or unwound to open and close the canopy.

In some embodiments, the tension member 130 passes around the spool 86 coupled to the driven sheave 56 and passes through the rotatable portion 111 of the transverse arm 108 to a lower runner 118 of the umbrella to open and close the canopy frame 116. In some embodiments, as the elevation of the transverse arm 108 is raised, the canopy frame 116 of the umbrella opens. As shown in FIG. 5, in some embodiments, the tension member 130 can have a fixed length such that as the transverse arm 108 is extended within the collar 120 to the extended configuration, the tension member 130 applies an upward force to the lower runner 118 of the canopy assembly to raise the lower runner 118 along the canopy shaft 115.

Figure 17:
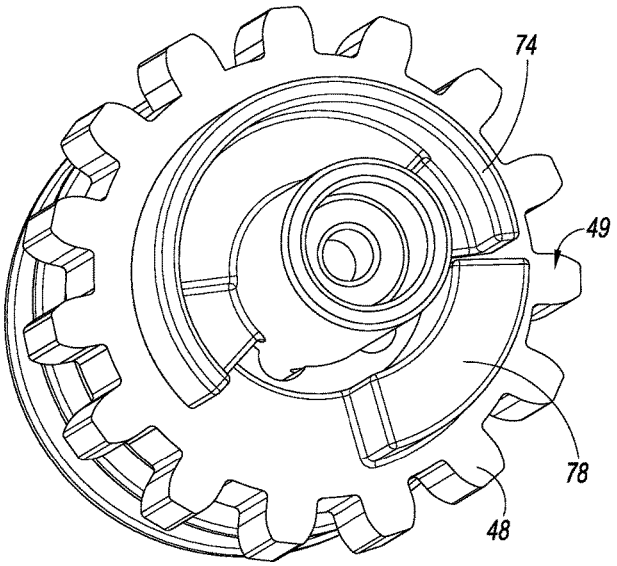
FIG. 17 is a view of the opposite side of the drive component shown in FIG. 16 of an integrated deployment mechanism for an umbrella assembly.

FIGS. 16 and 17 illustrate two views of the drive sheave 54 and the drive gear 48 coaxially mounted on the shaft 62 of the shaft assembly 49. In one embodiment, the outer surface of the drive component 70 is configured to engage with the drive sheave 54 when the crank 146 is positioned to engage the second mechanism 46 to open and close the canopy frame 116 by tensioning or releasing a tension member, as discussed in greater detail below. A view of the opposite side of the drive sheave 54 and drive gear 48 is shown in FIG. 17. As discussed above, the peripheral member 74 extends from the outer sleeve 66. The peripheral member is configured to abut a protrusion 78 to transfer torque as described more fully below. The peripheral member 74 comprises axial slots that are engaged by bearings B extending from the sleeve 66, as discussed in greater detail below.

Figure 18:
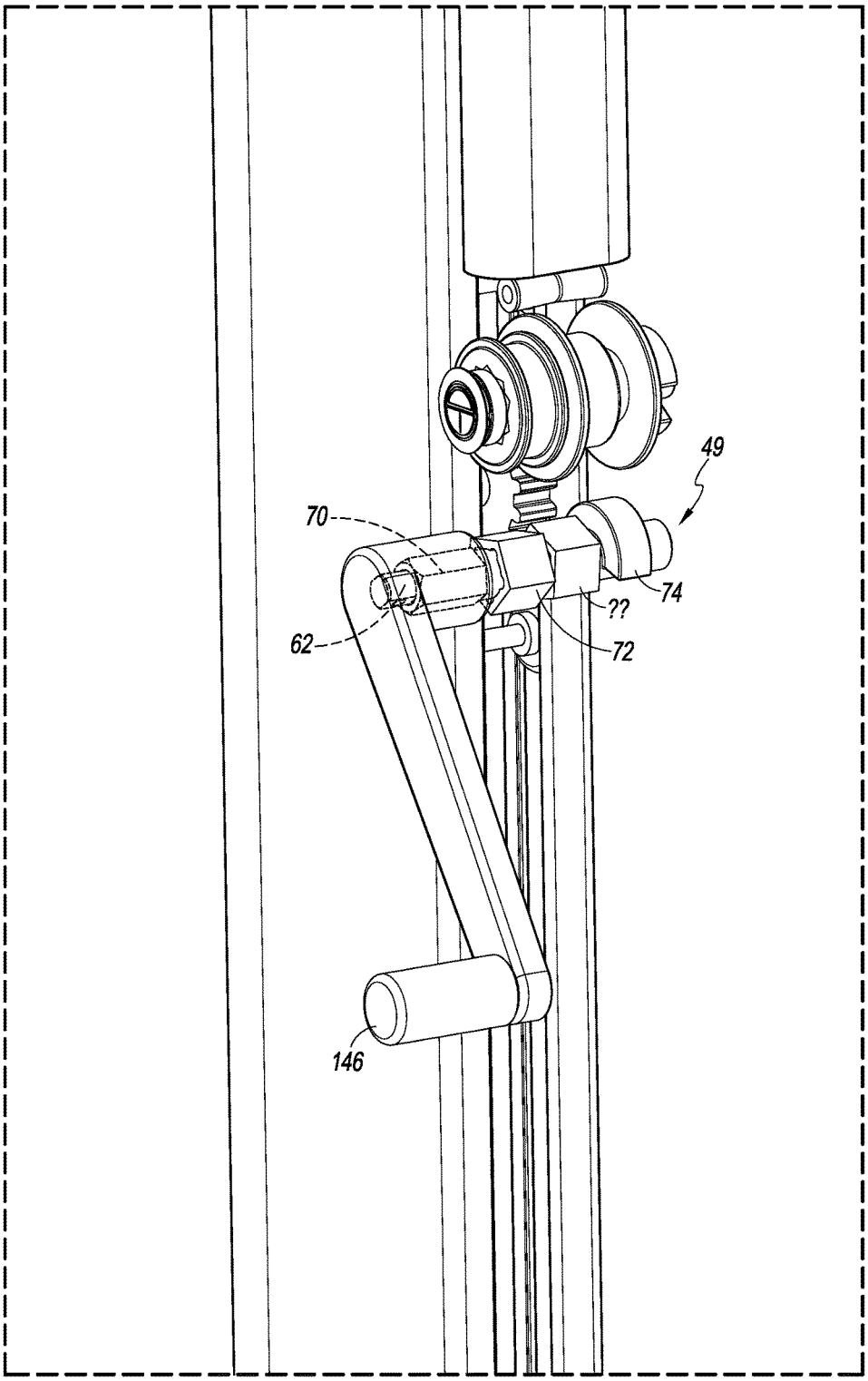
FIG. 18 is a view of drive and support components of an integrated deployment mechanism for an umbrella assembly.
Figure 20:
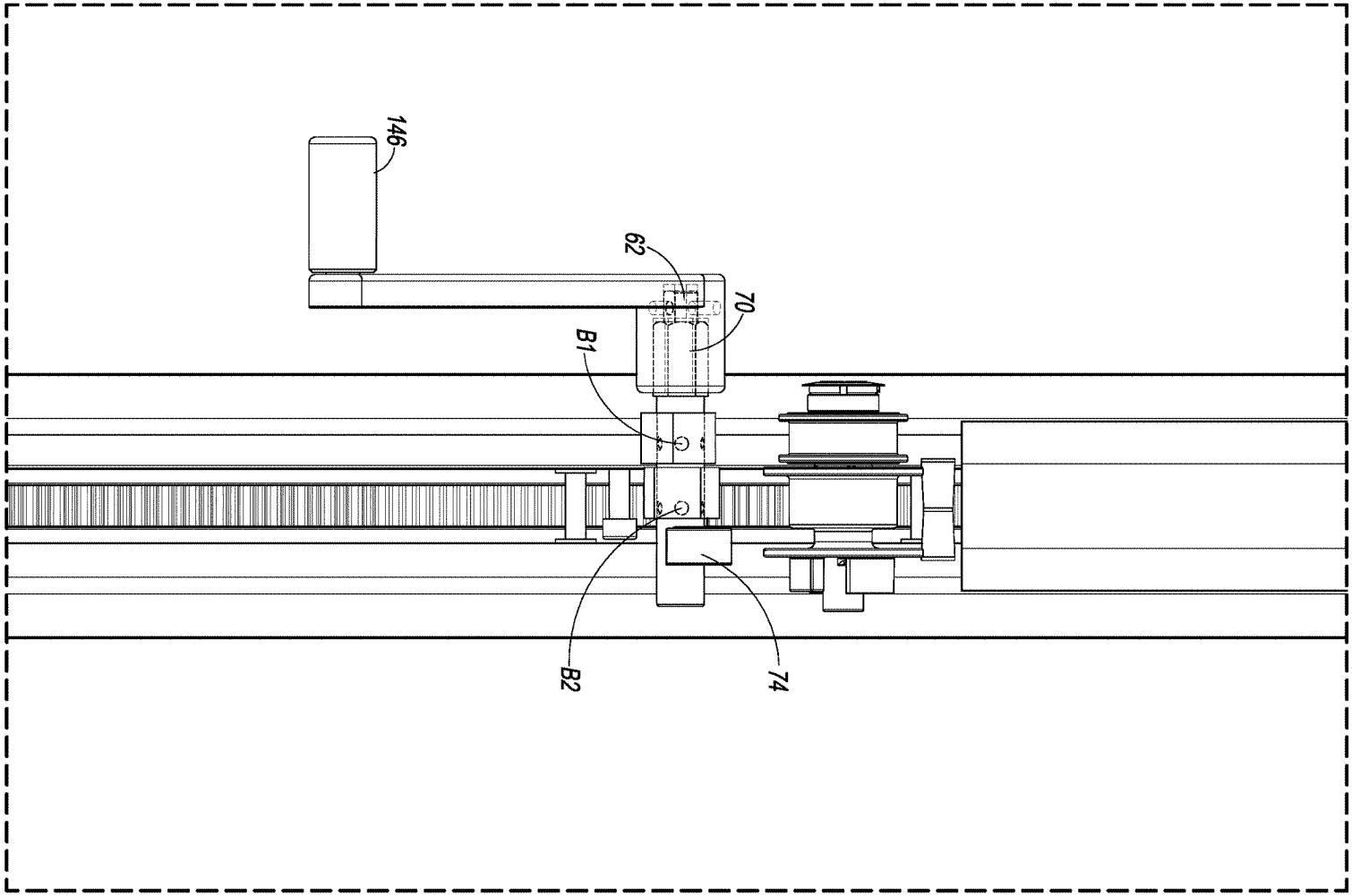
FIG. 20 is another view of an integrated deployment mechanism with the housing removed to show internal components thereof, illustrating a configuration in which the umbrella can be opened or closed.
Figure 21:
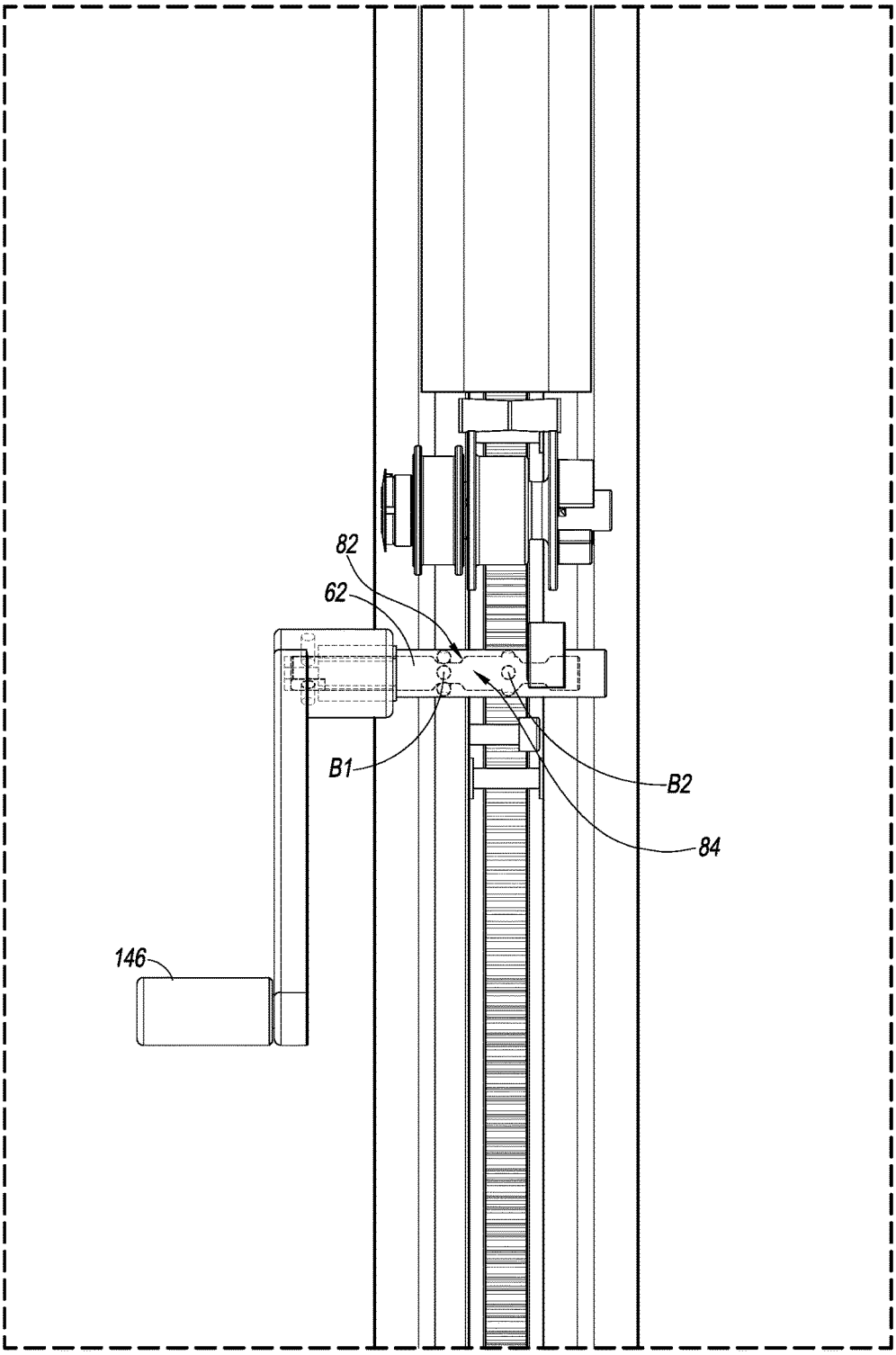
FIG. 21 is another view of an integrated deployment mechanism with the housing removed to show internal components thereof, illustrating a configuration in which the umbrella can be raised or lowered.
Figure 22:
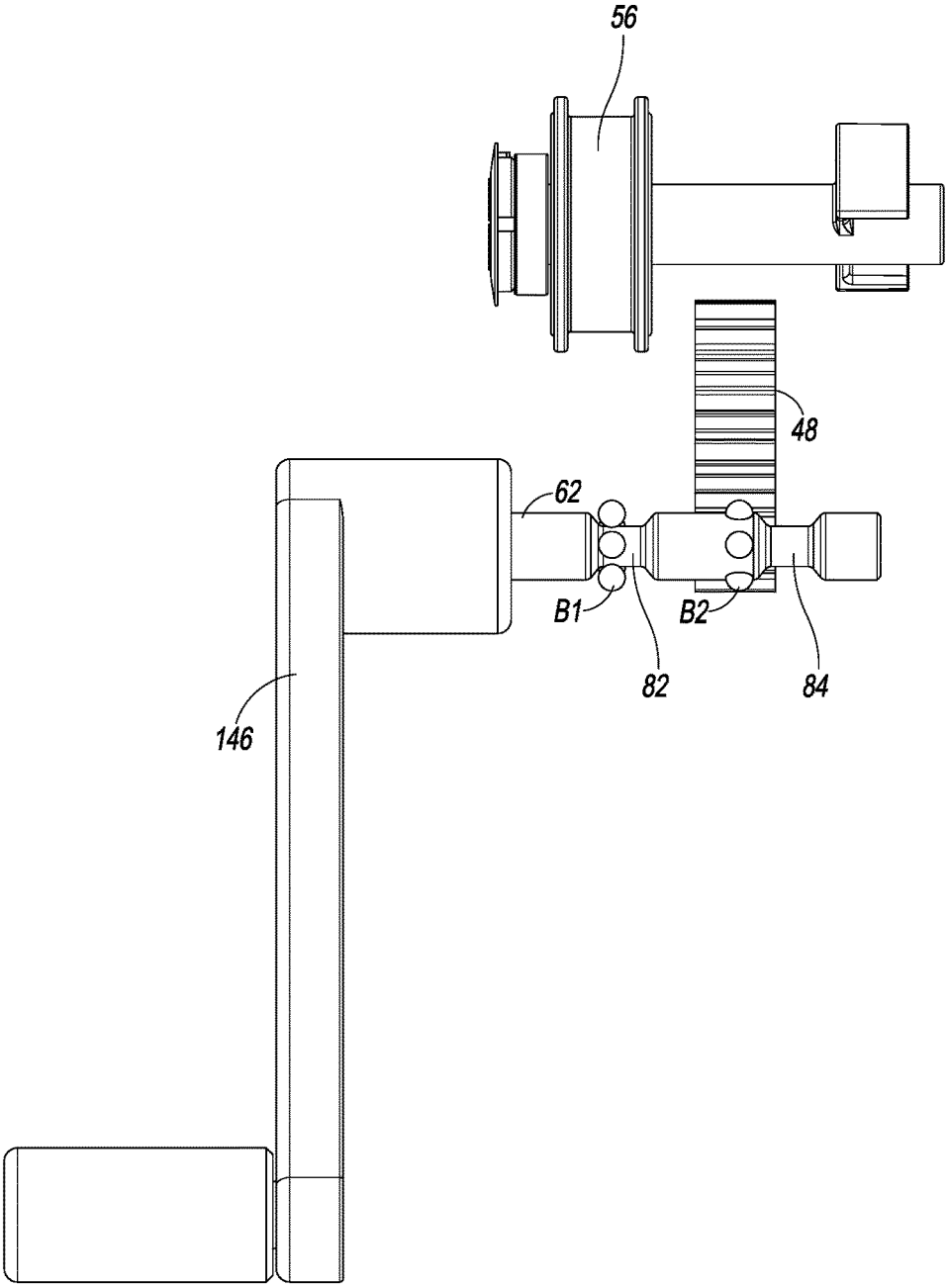
FIG. 22 is another view of internal components of an integrated deployment mechanism illustrating the structure of a rotating shaft assembly.
Figure 23:
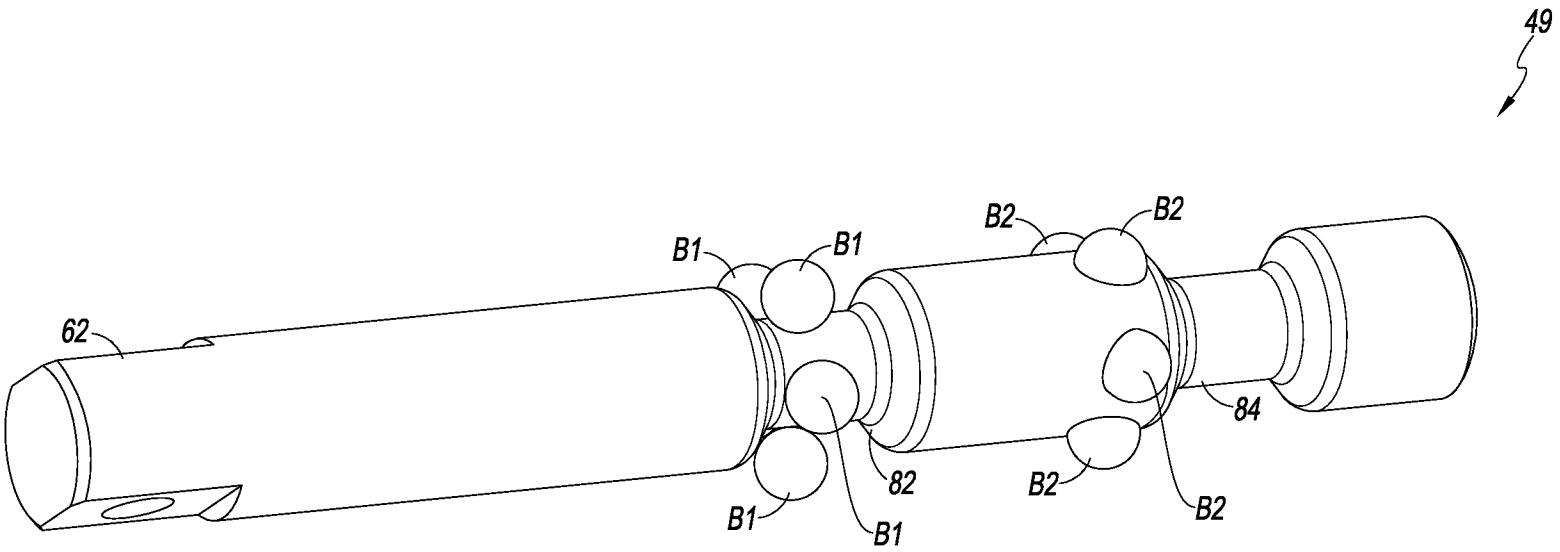
FIG. 23 is a detailed view of the shaft assembly shown in FIG. 22.
Figure 24:
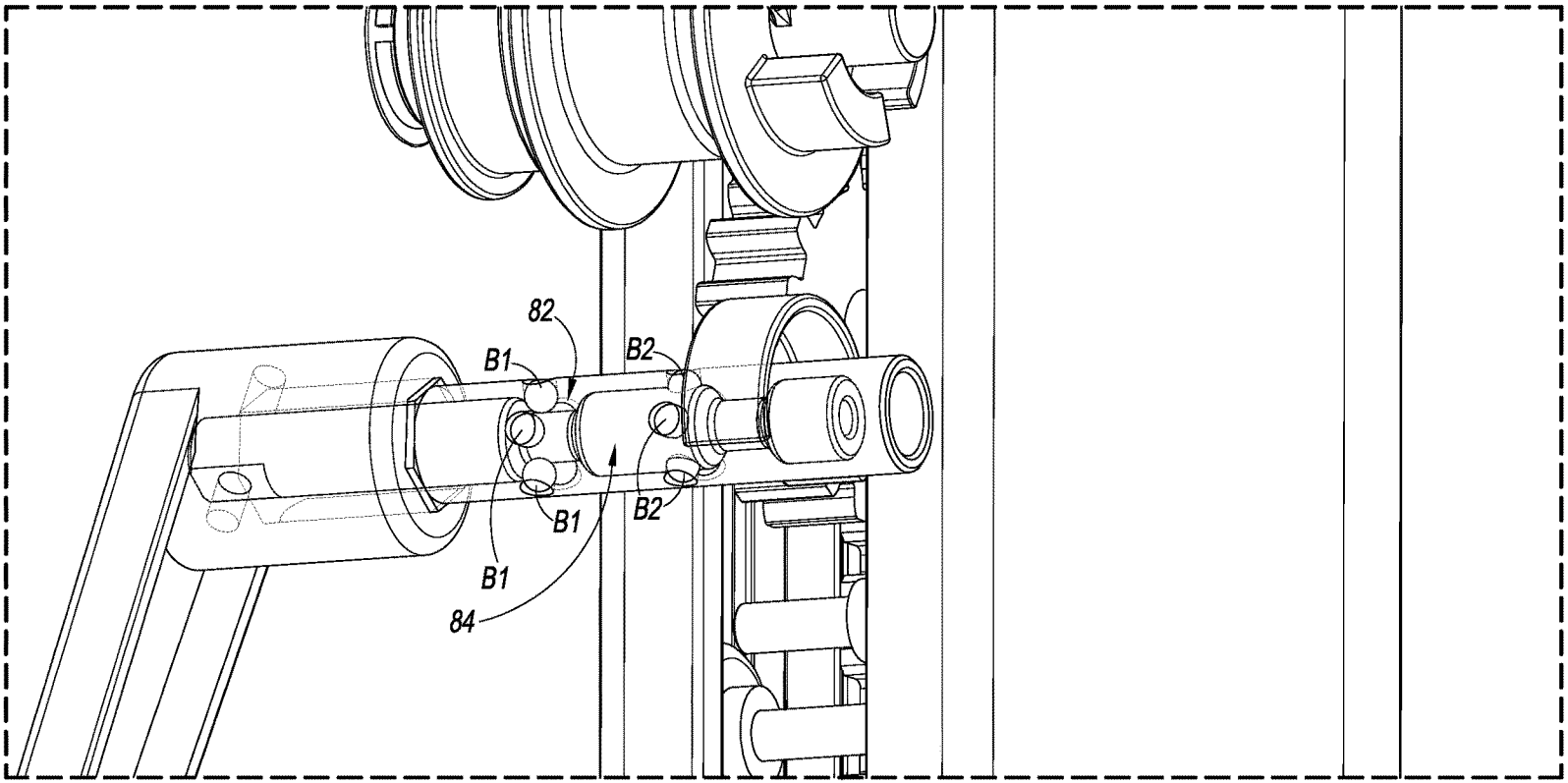
FIG. 24 is another view of the shaft assembly shown in FIG. 22 illustrated as part of an integrated deployment mechanism.
Figure 25:
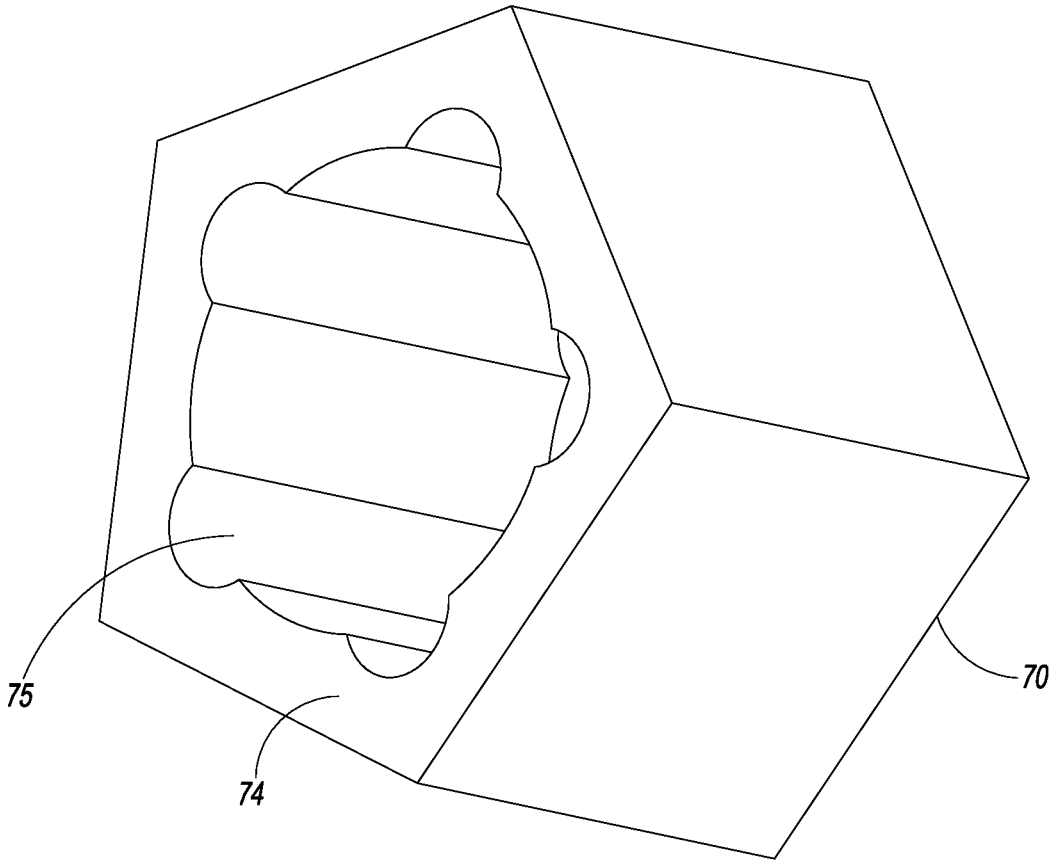
FIG. 25 illustrates a support and drive component of an integrated deployment mechanism.
Figure 26:
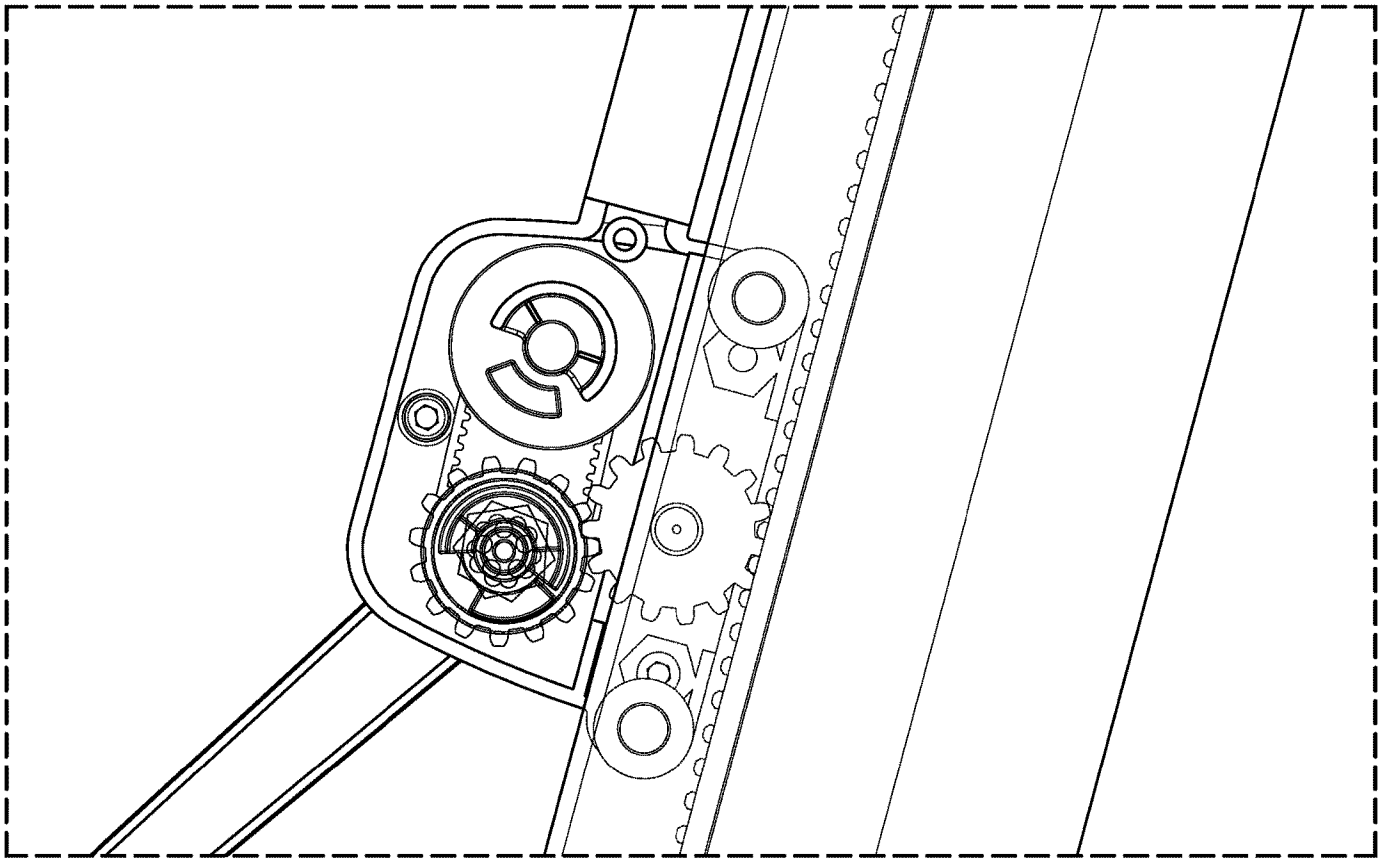
FIG. 26 is a side view of the integrated deployment mechanism of FIG. 14 illustrating the drive components of the integrated deployment mechanism.
Figure 26A:
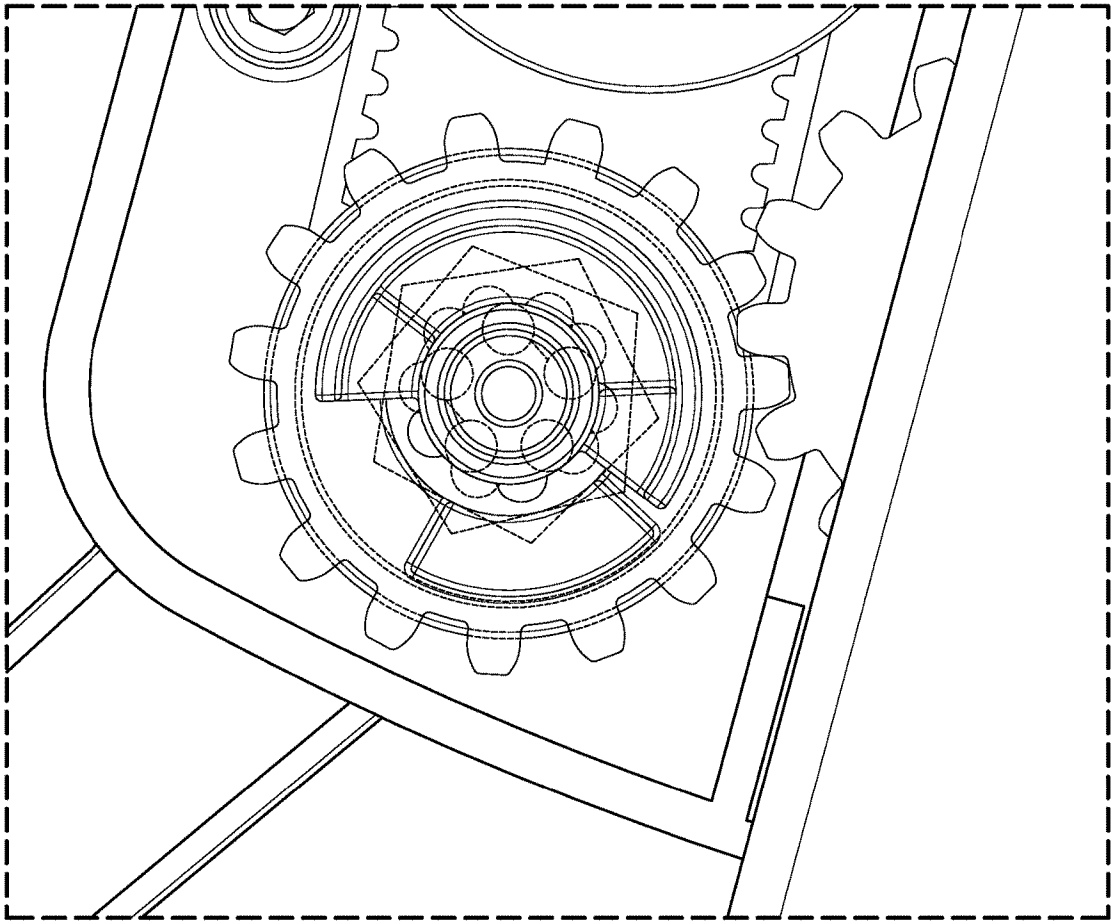
FIG. 26A is a detailed view of the drive components shown in FIG. 26.

FIGS. 18, 20, and 21 illustrate how transmission forces are achieved in two shifted positions of the crank 146 of the integrated deployment mechanism 155. As discussed above, the shaft assembly 49 includes an inner shaft 62, an outer sleeve 66, and a plurality of bearings B disposed between the inner shaft and the outer sleeve. The inner shaft 62 has two reduced diameter sections (see FIG. 22) where the bearings B can shift radially inwardly to not protrude from the sleeve 66. When not in the reduced diameter sections, the bearings B protrude from the sleeve 66. When protruding, the bearings B engage axial slots 75 in drive components 70, 72 coaxially mounted on the shaft 62. As the shaft 62 is translated left and right (that is, to a first configuration when the shaft 62 is in the furthest right position and to a second configuration when the shaft 62 is in the furthest left position), the bearings B will shift radially to either be in a reduced diameter section 82, 84 of the shaft 62 or in an expanded diameter section of the shaft 62 (as shown in FIGS. 22 and 23) such that the bearings B protrude from the sleeve 66 through openings 67.

Referring back to FIG. 16, the drive component 70 has a non-round outer perimeter that engages a correspondingly shaped space in the drive sheave 54. In one position of the crank 146, the drive component 70 engages the correspondingly shaped space in the drive sheave 54 to transfer torque to the second mechanism 46. In this manner, drive torque is transmitted to the drive sheave 54. Rotation of the drive sheave 54 rotates the belt 50, causing rotation of the driven sheave 56. The drive sheave 56 includes a spool 86 around which a tension member, such as the tension member 130, may be wound or unwound to open and close the canopy as discussed above. A similar engagement can be provided between the bearings B and the drive component configured to drive rotation of the drive gear 48 of the first mechanism 42. As a further mode of transferring torque, the outer sleeve 66 can have a peripheral member 74 disposed to abut a protrusion 78 disposed on a side of the drive gear 48, as discussed above with reference to FIGS. 15 and 17. Where the peripheral member 74 and protrusion 78 are provided, the sleeve 66 may be required to shift laterally to disengage the driving relationship between the crank 146 and shaft assembly 49 on one hand and the drive gear 48 on the other.

As described, the crank 146 can operate both of the mechanisms 42, 46 by shifting position of the crank. Such shifting moves the peripheral member 74 to a position lateral of the protrusion 78 so that the member 74 can freely rotate without driving the protrusion. Position shifting of an axle may be found in wind-up watches, where a first position compresses a spring to store strain energy and a second position moves the hands.

Integrated Mechanism with Plurality of Shaft Positions

Figure 27:
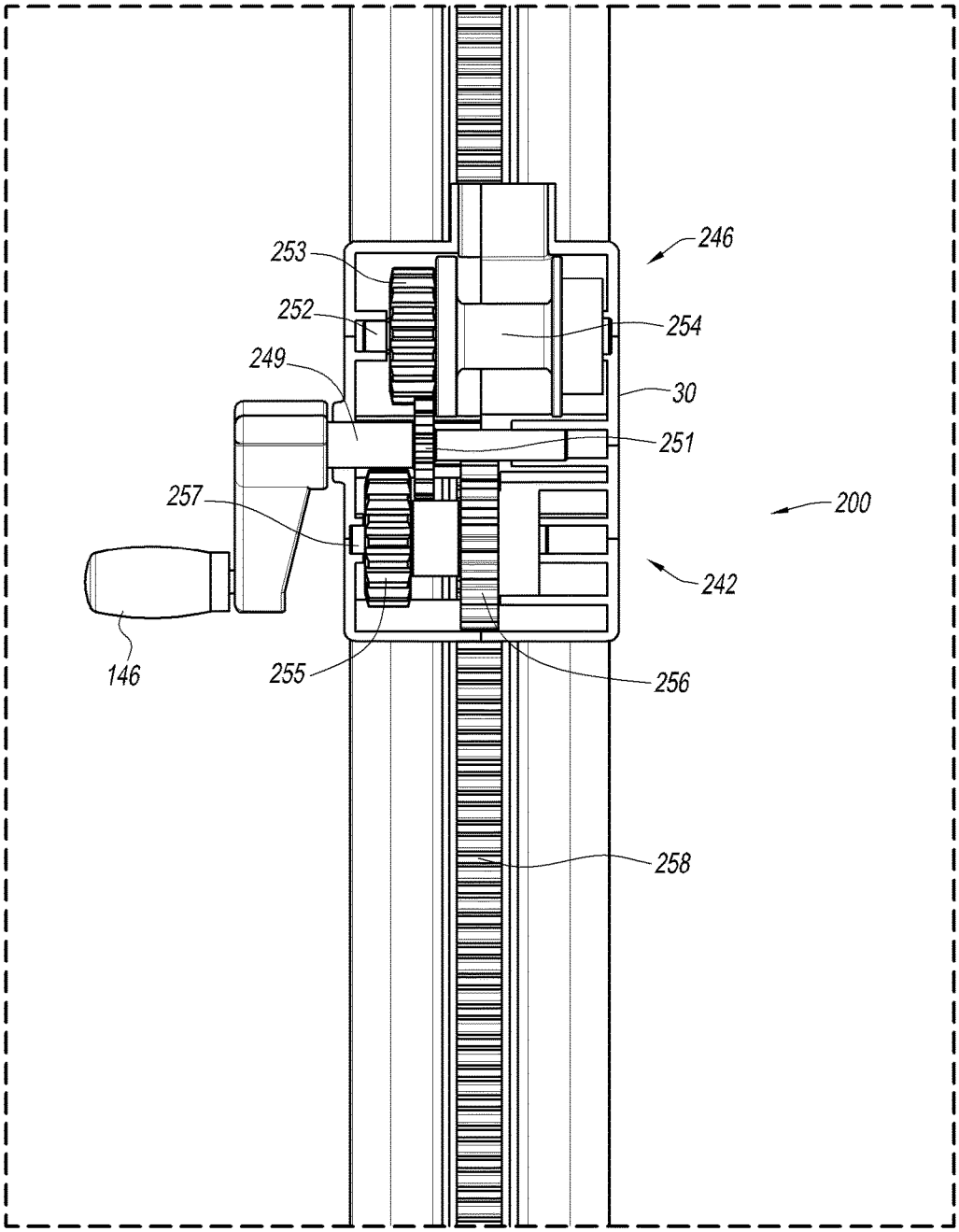
FIG. 27 is a front view of an integrated deployment mechanism according to another embodiment.
Figure 28:
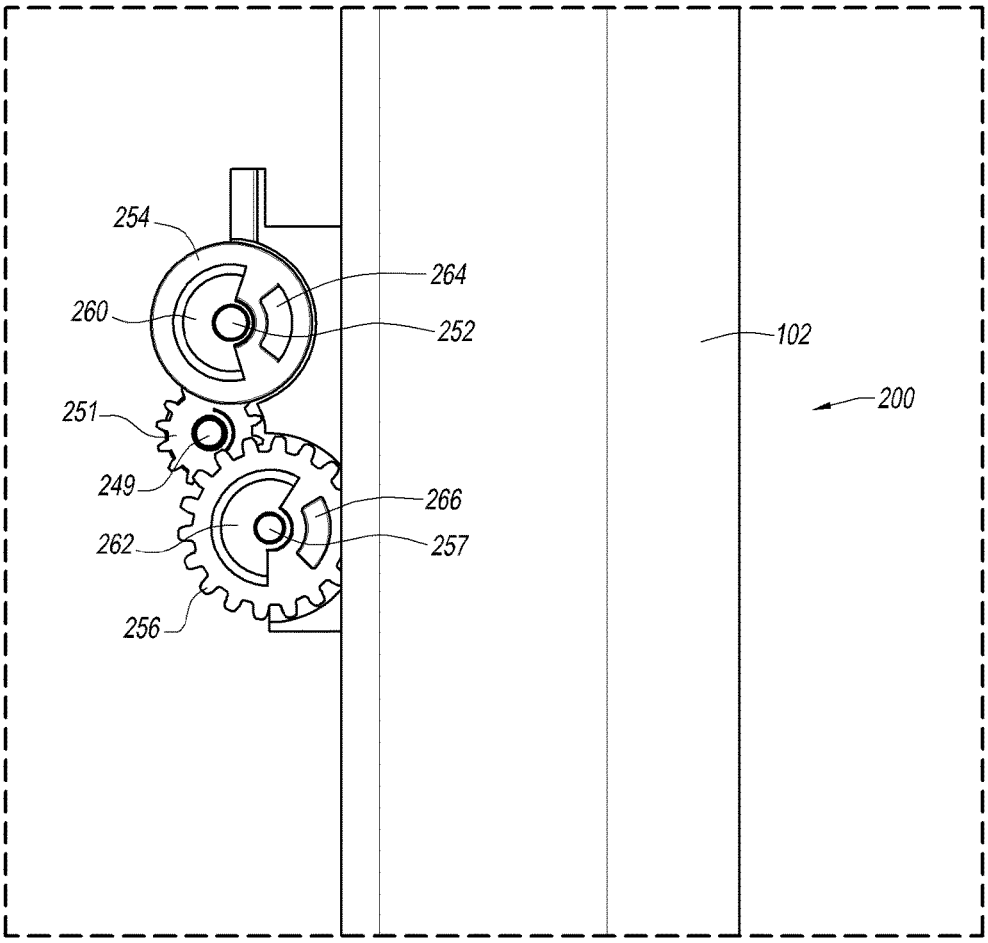
FIG. 28 is a side view of the integrated deployment mechanism shown in FIG. 27.

FIGS. 27 and 28 illustrate a second embodiment of an integrated deployment mechanism 205, which in some embodiments provides a mechanism for activating the canopy frame 116 from a closed to an open position, to raise and lower the cantilever beam 108, or to both open and close the canopy and to raise and lower the cantilever beam. In some embodiments, such as the embodiment shown in FIGS. 27 and 28, the opening and closing mechanism may be operated separate from or at the same time as the raising and lowering mechanism. In some embodiments, such as the embodiment shown in FIGS. 27 and 28, the raising and lowering mechanism may be operated separate from the opening and closing mechanism, In some embodiments, such as the embodiment shown in FIGS. 27 and 28, the integrated mechanism 205 includes a gear box or housing 30 that is positioned on the upright pole 102. The housing 30 includes a first mechanism 242 to raise and lower the cantilever beam or transverse arm 108 (and canopy) and a second mechanism 246 to open and close the canopy frame 116. The crank 146 is attached to a first crankshaft assembly 249. A drive gear 251 is coaxially mounted on the first shaft assembly 249 coupled with the crank 146 such that translation of the shaft assembly 249 left and right also causes the drive gear 251 to translate left and right. The first mechanism 242 includes a driven gear 255 mounted on a second shaft assembly 257. A pinion gear 256 is also coaxially mounted on the second shaft assembly 254 with the driven gear 255. The pinion gear 256 meshes or mates with a rack gear 258 in a rack and pinion gear system to raise and lower the transverse arm 108 and the canopy. A spool gear 253 is mounted on a third shaft assembly 252 adjacent to a spool 254 that is coaxially mounted on the third shaft assembly 252.

As the crank 146 and first shaft assembly 249 are translated left and right, the drive gear 251 is translated left and right to interact with the first mechanism 242, the second mechanism 246, or both the first and second mechanisms 242, 246.

As shown, and similar to the integrated deployment mechanism 155 discussed above, the integrated deployment mechanism 205 may be attached to a support member that is rotatably connected to the sliding connection member of the support pole. The crank 146 may be shifted along the axis defined by the first shaft assembly 249 to engage the drive gear 251 with either the first mechanism 242 to raise and lower the transverse arm 108 (and canopy), the second mechanism 246 to open and close the canopy frame 116, or both the first and second mechanism 242, 246. As described below, the crank 146 can operate one or both of the mechanisms 242, 246 by shifting position of the crank.

In a first configuration, the crank 146 is in a first position such that the drive gear 251 is positioned to engage the first mechanism 242 to raise and lower the transverse arm 108. In this configuration, the crank 146 is in a far left position relative to the housing 30. In other words, when the crank 146 is positioned to a far left position, the drive gear 251 will engage only the driven gear 255 of the first mechanism 242. In this position, the drive gear 251 engages the driven gear 255 mounted on the shaft assembly 257, causing rotation of the shaft assembly 257 and the pinion gear 256. As the pinion gear 256 rotates, the housing 30 will travel vertically upwards or downwards along the upright pole 102, depending on the direction of rotation of the crank 146. The vertical translation of the housing 30 also results in vertical translation of the transverse arm or cantilever beam 108.

In a second configuration, the crank 146 is in a second position such that the drive gear 251 is positioned to engage the second mechanism 246 to open and close the canopy frame 116. In this configuration, the crank 146 and the shaft assembly 249 are shifted to the far right of the housing 30, as shown in FIG. 27. In this position, the drive gear 251 will engage only the spool gear 253 mounted on the shaft assembly 252, causing rotation of the shaft assembly 252 and the spool 254. As the spool 254 rotates, a tension member, such as a cord, is wound or unwound from the spool 254 to open or close the canopy frame 116 as discussed in greater detail above.

In a third configuration, the crank 146 is in a third position such that the drive gear 251 engages with both the driven gear 255 of the first mechanism 242 and the spool gear 253 of the second mechanism 246. In this configuration, the drive gear 251 is positioned between the far left position of the first configuration and the far right position of the second configuration. Rotation of the crank 146 in the third position results in simultaneous opening and closing of the canopy frame 116 as well as vertical translation of the housing 30 and the transverse arm 108.

As shown in FIG. 28, the shaft assembly 252 includes a peripheral member 260 that is configured to engage with a peripheral member 264 formed integral with the spool 254. Similarly, the shaft assembly 257 includes a peripheral member 262 that is configured to engage with a peripheral member 266 formed integral with the gear 256. The peripheral member 260 may be formed integral with the shaft assembly 252. Similarly, the peripheral member 262 may be formed integral with the shaft assembly 257. The peripheral member 260 is configured to abut the peripheral member 264 to provide additional torque to rotate the spool 254 about the axis defined by the shaft assembly 252. Similarly, the peripheral member 262 is configured to abut the peripheral member 266 to provide additional torque to rotate the gear 256 about the axis defined by the shaft assembly 257.

Integrated Mechanism with Plurality of Drive Gear Positions

Figure 29:
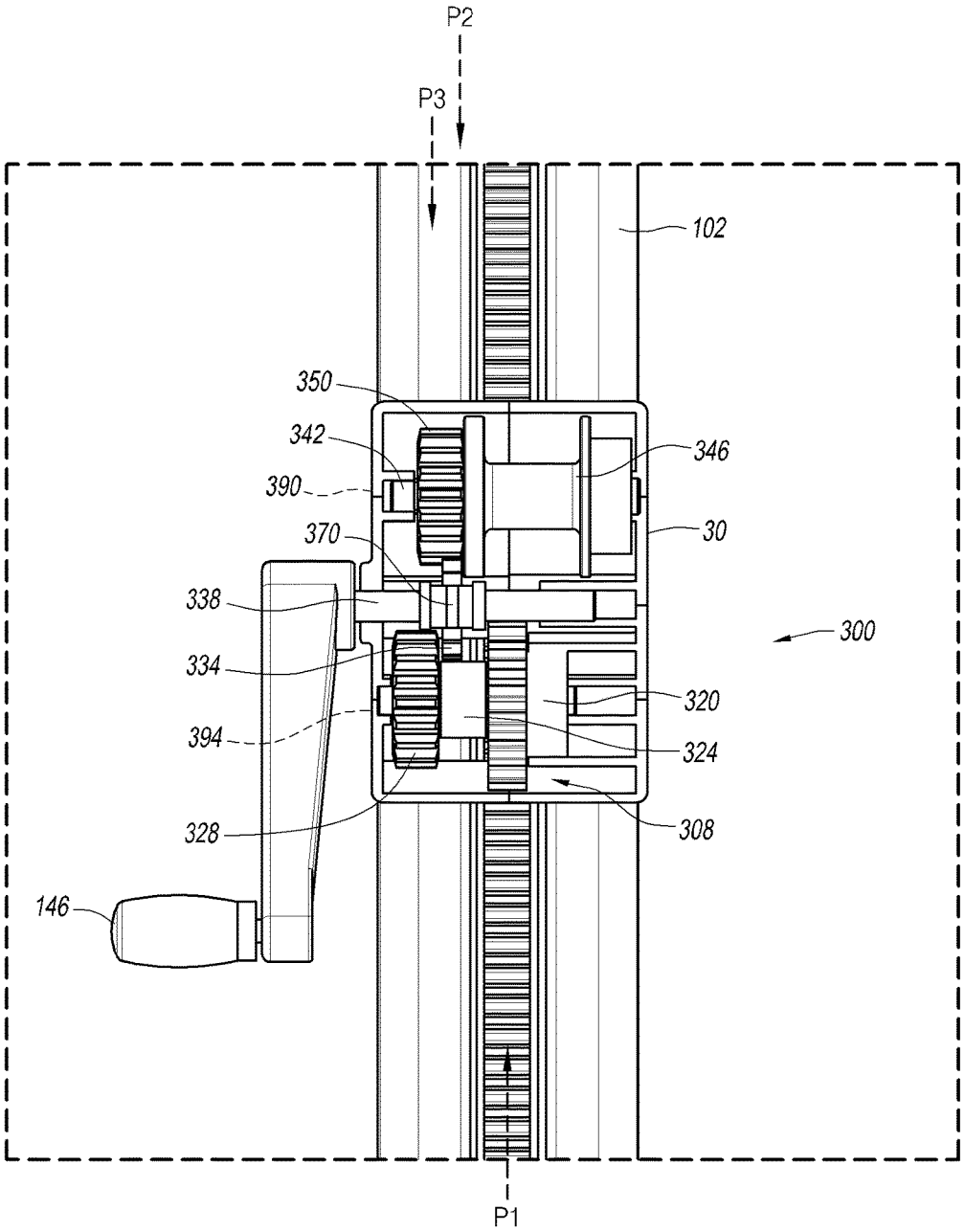
FIG. 29 is a front view of an integrated deployment mechanism according to another embodiment.
Figure 30:
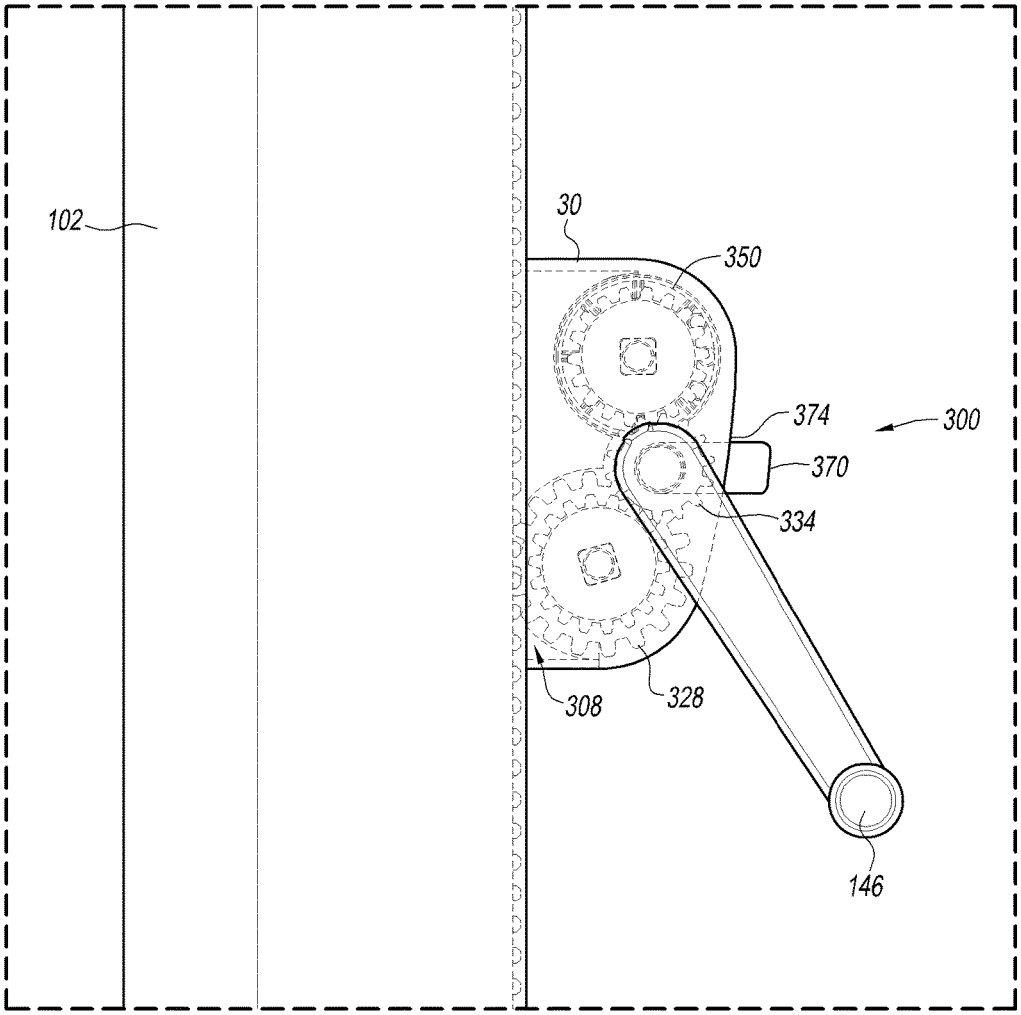
FIG. 30 is a side view of the integrated deployment mechanism shown in FIG. 29.

FIGS. 29 and 30 show another configuration of an integrated mechanism 300 configured to control multiple aspects of the umbrella 100 or an umbrella assembly that could be include all or some of the components of the umbrella 100. The umbrella assembly or the umbrella 100 includes the upright pole 102. The integrated mechanism 300 is disposed on the upright pole 102. The integrated mechanism 300 can be configured to control opening of the canopy frame 116. The integrated mechanism 300 can be configured to control raising and/or lowering of the cantilever beam 108.

The integrated mechanism 300 can comprise the gear box or similar housing 30, the crank 146, and a rack and pinion gear assembly 308 to be coupled to the crank 146. The rack and pinion gear assembly 308 is configured to raise and lower the gear box 304 and the cantilever beam 108, as discussed above. For a particularly tall or large umbrella, the gear back may be disposed at a lower elevation than the beam 108. Although not shown in FIGS. 29 and 30, the support member 202 shown in FIG. 13 can be disposed between the gear box 30 and the connection member 104. The support member 202 is rigid enough to transfer a lifting force from the integrated mechanism 300 to the connection member 104 and thereby to the cantilever beam 108.

The rack and pinion gear assembly 308 can include a pinion gear 320 disposed on a shaft 324. The shaft 324 is journaled in the gear box 30. In some embodiments, a driven gear 328 also is mounted on the shaft 324. In some embodiment, either one of or both of the pinion gear 320 and the driven gear 328 can be driving to cause rotation of the shaft 324 as discussed further below.

The integrated mechanism 300 can be configured such that the crank 146 can be disposed in a first position. When in the first position the crank 146 controls an upward and downward motion of the cantilever beam 108. For example, a drive gear 334 disposed on a shaft 338 can be rotated by the crank 146. The drive gear 334 can be mated with the pinion gear 320 in the first position. FIG. 29 shows an arrow P1 that can correspond to the first position.

The integrated mechanism 300 also can be used to control an opening and closing of the canopy frame 116. In one embodiment, a shaft 342 is journaled in the gear box 30. The shaft 342 can have a spool 346 or other device mounted thereon to gather or deploy a tension member, a cord or other device to remotely pull the canopy frame 116 to an open position. The shaft 342 can also have a gear 350 mounted thereon.

In some embodiment, the crank 146 and the drive gear 334 can be disposed in a second position indicated the by arrow P2. In this position rotation of the crank 146 rotates the shaft 342 and thereby the gear 350 to cause the spool 347 to rotate to control an opening and closing motion of the canopy frame 116. FIG. 29 shows the crank 146 and the drive gear 334 in the second position indicated by the arrow P2.

FIGS. 29-30 show that the drive gear 334 disposed on the crankshaft 338 is translatable relative to the longitudinal axis of the upright pole 102 from the first position P1 in which the drive gear 334 disposed on the crankshaft 338 engages the pinion gear 320 to enable the integrated mechanism to raise or lower the canopy frame 116 to the second position P2 in which the drive gear 334 engages the driven gear 350 to enable the integrated mechanism 300 to rotate the shaft 342 having the spool 346 mounted thereon. The spool 346 is coupled with a tension member (not shown) that is also coupled with the canopy frame 116 as discussed above to open and close the canopy frame.

FIG. 29 also shows that the drive gear 334 is translatable to a third position indicated by the arrow P3 in which the drive gear 334 disposed on the crankshaft 338 engages the driven gear 328, which is disposed peripherally of the pinion gear 320. The peripheral driven gear 328 can be mounted on the shaft 324 as discussed above. When the drive gear 334 is coupled with the peripheral driven gear 324 and the driven gear 350 the integrated mechanism 300 simultaneously raise the canopy frame 116 and open the canopy frame or simultaneously lowers and closes the canopy frame 116. Movement between the first, second and third positions P1, P2, P3 can be achieved by moving the crankshaft 338 as discussed above in connection with FIGS. 27 and 28 or by shifting the drive gear 334 on the drive shaft 338.

FIGS. 29 and 30 show that the drive gear 334 can be coupled with an actuator 370. The actuator 370 can be configured to extend through an aperture 374 in the gear box 30. The actuator 370 and the drive gear 334 can be slidably coupled with the crankshaft 338 such that the actuator 370 can be actuated to move the drive gear 334 laterally or transverse to the longitudinal axis of the upright pole 102 between any two or more of the positions P1, P2, and P3 discussed above. In use, the user can manipulate the actuator 370 to position the drive gear in line with the gear 320, the gear 350, or the gear 328 and the gear 350. Thereafter the crank 146 can be rotated to cause the cantilever beam 108 to be raised or lowered, to cause the canopy frame 116 to be opened or closed, to cause the cantilever beam 108 to be raised while at the same time causing the canopy frame 116 to be opened or to cause the cantilever beam 108 to be lowered while at the same time causing the canopy frame 116 to be closed.

In another embodiment, the crankshaft 338 and the drive gear 334 can be eliminated. For example, the mechanism 300 can be modified such that a first aperture 390 in the gear box 30 provides access for the crank 146 to be coupled with a crank interface at the end of the shaft 342. Where so provided the crank interface can be disposed adjacent to the first aperture 390 (if present). The mechanism 300 can be modified such that a second aperture 394 in the gear box 30 provides access for the crank 146 to be coupled with a crank interface at the end of the shaft 324. Where so provided the crank interface can be disposed adjacent to the second aperture 394 (if present).

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella assembly comprising:

an upright pole having a longitudinal axis;

a canopy frame supported by the umbrella assembly in a cantilever manner by a cantilever beam; and an integrated mechanism comprising a drive gear disposed in a housing configured to be coupled with a first mechanism to raise and lower the cantilever beam and to be coupled with a second mechanism to open and close the canopy frame, wherein the drive gear is coupled with a crankshaft, the crankshaft and the drive gear having a first position within the housing in which the drive gear is coupled to the first mechanism to raise and/or lower the housing relative to the upright pole, the crankshaft and the drive gear having a second position within the housing in which the drive gear is coupled to the second mechanism to wind or unwind a tension member coupled with the canopy frame, the crankshaft and the drive gear having a third position within the housing in which the drive gear is coupled to both the first mechanism and the second mechanism.

2. The umbrella assembly of claim 1, wherein the first mechanism comprises a pinion gear of a rack and pinion assembly, wherein the second mechanism comprises a spool.

3. An umbrella assembly comprising:

an upright pole having a longitudinal axis;

a canopy frame supported by the umbrella assembly in a cantilever manner by a cantilever beam; and an integrated mechanism disposed on the upright pole and configured to control both opening and closing of the canopy frame and raising and lowering of the cantilever beam, the integrated mechanism comprising:

a gear box mounted on the upright pole, a crankshaft having a first position and a second position, and a drive gear to be coupled to the crankshaft and mounted within the gear box, the drive gear configured to be rotated and when so rotated to raise and lower the drive gear and the gear box along the upright pole and thereby to raise and lower the cantilever beam, wherein the crankshaft when in the first position is configured to control an upward and downward motion of the cantilever beam, the crankshaft when in the second position configured to control an opening and closing motion of the canopy frame.

4. The umbrella assembly of claim 3, wherein the integrated mechanism further comprises a rack and pinion gear assembly to be coupled to the crankshaft and the drive gear, wherein the integrated mechanism is configured to raise and lower the gear box and the cantilever beam.

5. The umbrella assembly of claim 3, wherein the crankshaft comprises a stepped shaft that is translatable relative to a drive or driven member such that at least one mechanism can be engaged and at least one mechanism can be disengaged depending on the position of a narrow section of the shaft relative to the drive or driven members.

6. The umbrella assembly of claim 3, wherein the drive gear is disposed on the crankshaft, wherein the crankshaft is translatable relative to the longitudinal axis of the upright pole from the first position in which the drive gear disposed on the crankshaft engages a driven gear to enable the integrated mechanism to raise or lower the canopy frame to a second position in which the drive gear disposed on the crankshaft engages a spool gear to enable the integrated mechanism to rotate a shaft having a spool mounted thereon, the spool coupled with a tension member to open and close the canopy frame.

7. The umbrella assembly of claim 6, wherein the drive gear is translatable to a third position in which the drive gear disposed on the crankshaft engages a peripheral gear coupled with the driven gear and the spool gear to enable the integrated mechanism to simultaneously raise the canopy frame and open the canopy frame or to lower the canopy frame and to close the canopy frame.

8. The umbrella assembly of claim 7 wherein the drive gear is immovably mounted on the crankshaft and the crankshaft is translatable to move the drive gear between the first and second and optionally the third position.

9. The umbrella assembly of claim 3, wherein the integrated mechanism further comprises an integrated clutch and tilt mechanism operable to rotate the canopy frame about an axis extending through the cantilevered beam, the integrated clutch and tilt mechanism including a rotatable shaft disposed in the cantilevered beam, a first member rotatable with respect to a second member, the second member rotatable with the rotatable shaft and slidable with respect to the rotatable shaft from a locked position to an unlocked position, wherein when the second member is in the unlocked position the first and second members are rotatable with the rotatable shaft.

10. The umbrella assembly of claim 9, wherein the second member comprises an opening surrounding the rotatable shaft such that the first member can rotate relative to the shaft when the second member is in the locked position and can rotate the rotatable shaft when the second member is in the unlocked position.

11. The umbrella assembly of claim 10, wherein the opening comprises a first surface configured to act on the rotatable shaft to cause the shaft to rotate in a clockwise direction and a second surface configured to prevent rotation of the rotatable shaft in a counter-clockwise direction.

12. An umbrella assembly comprising:

an upright pole having a longitudinal axis;

a canopy frame supported by the umbrella assembly in a cantilever manner by a cantilever beam, the cantilever beam having a first end disposed away from the upright pole and a second end disposed adjacent to the upright pole; and an integrated mechanism configured to control multiple aspects of the umbrella assembly, the integrated mechanism comprising:

a gear box, and a drive assembly having a drive gear disposed on a crankshaft, wherein at least a portion of the drive assembly is translatable relative to the longitudinal axis of the upright pole from a first position in which the drive gear engages a mechanism to raise or lower the canopy frame to a second position in which the drive gear engages a spool gear to enable the integrated mechanism to rotate a shaft having a spool mounted thereon, the spool coupled with a tension member to open and close the canopy frame, and wherein at least a portion of the crankshaft remains disposed within the gear box when the drive assembly translates from the first position to the second position.

13. The umbrella assembly of claim 12, wherein the integrated mechanism is configured to control both opening and closing of the canopy frame and raising and lowering of the cantilever beam.

14. The umbrella assembly of claim 12, wherein the integrated mechanism is disposed on the upright pole.

15. The umbrella assembly of claim 12, wherein the integrated mechanism further comprises a rack and pinion gear assembly to be coupled to the crankshaft and configured to raise and lower the gear box and the cantilever beam.

16. The umbrella assembly of claim 12, wherein the crankshaft comprises a stepped shaft that is translatable relative to a drive or driven member such that at least one mechanism can be engaged and at least one can be disengaged depending on the position of a narrow section of the shaft relative to the drive or driven members.

17. The umbrella assembly of claim 12, wherein the portion of the drive assembly is translatable to a third position in which the drive gear engages a peripheral portion of the driven gear and the spool gear to enable the integrated mechanism to simultaneously raise the canopy frame and open the canopy frame or to lower the canopy frame and to close the canopy frame.

18. The umbrella assembly of claim 12 further comprising an integrated clutch and tilt mechanism operable to rotate the canopy frame about an axis extending through the cantilever beam, the integrated clutch and tilt mechanism including a rotatable shaft disposed in the cantilever beam, a first member rotatable with respect to a second member, the second member rotatable with the rotatable shaft and slidable with respect to the rotatable shaft from a locked position to an unlocked position, wherein when the second member is in the unlocked position the first and second members are rotatable with the rotatable shaft.

19. The umbrella assembly of claim 18, wherein the integrated clutch and tilt mechanism comprises a lever disposed at the second end of the cantilever beam such that rotation of the lever drives rotation of the first member.

20. The umbrella assembly of claim 18, wherein the second member comprises an opening surrounding the rotatable shaft such that the first member can rotate relative to the rotatable shaft when the second member is in the locked position and can rotate the rotatable shaft when the second member is in the unlocked position.

21. The umbrella assembly of claim 20, wherein the opening comprises a first surface configured to act on the rotatable shaft to cause the rotatable shaft to rotate in a clockwise direction and a second surface configured to prevent rotation of the rotatable shaft in a counter-clockwise direction.

22. The umbrella assembly of claim 12, wherein the drive assembly shares a common rotational axis when in the first position and in the second position.

23. An umbrella assembly comprising:

an upright pole having a longitudinal axis;

a canopy frame supported by the umbrella assembly in a cantilever manner by a cantilever beam; and an integrated mechanism configured to control multiple aspects of the umbrella assembly, the integrated mechanism comprising:

a gear box, a crankshaft, and a drive gear located within the gear box, wherein the drive gear has a position in which the drive gear is coupled with a first mechanism to raise and/or lower the gear box and the cantilever beam and at the same time is coupled with a second mechanism to wind or unwind a tension member coupled with the canopy frame to open and/or close the canopy frame.

24. The umbrella assembly of claim 23, wherein the drive gear has a second position in which the drive gear is coupled to the first mechanism.

25. The umbrella assembly of claim 23, wherein the drive gear has a second position in which the drive gear is coupled to the second mechanism.

26. The umbrella assembly of claim 23, wherein the drive gear is coupled with the crankshaft.

27. The umbrella assembly of claim 23, wherein the first mechanism comprises a pinion gear of a rack and pinion assembly.

28. The umbrella assembly of claim 23, wherein the second mechanism comprises a spool.

* * * * *